US010761453B2

(12) United States Patent
Kihara et al.

(10) Patent No.: US 10,761,453 B2
(45) Date of Patent: Sep. 1, 2020

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Takayoshi Kihara, Suntou-gun (JP); Shuhei Kawasaki, Susono (JP); Yoshihiro Mitsui, Numazu (JP); Yasukazu Ikami, Tokyo (JP); Shunsuke Matsushita, Yokohama (JP); Takuya Oka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/680,747

(22) Filed: Nov. 12, 2019

(65) Prior Publication Data

US 2020/0150557 A1 May 14, 2020

(30) Foreign Application Priority Data

Nov. 14, 2018 (JP) ..... 2018-213818

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
CPC ..... G03G 15/0808; G03G 15/0812
See application file for complete search history.

(56) References Cited

U.S. PATENT DOCUMENTS 5,557,060 A * 9/1996 Okada ..... G03G 15/0806 399/284
5,655,197 A 8/1997 Okada
(Continued)

FOREIGN PATENT DOCUMENTS

JP 2005121795 A * 5/2005
JP 2006146056 A 6/2006
JP 2017097161 A 6/2017

OTHER PUBLICATIONS

Machine Translation of JP2005-121795. May 12, 2005. (Year: 2005).*

(Continued)

*Primary Examiner* — Carla J Therrien
(74) *Attorney, Agent, or Firm* — Rossi, Kimms & McDowell LLP

(57) ABSTRACT

A developer on a developer bearing member includes a toner having a toner particle including a binder resin and an inorganic particle present on the surface of the toner particle. A fixing ratio of the inorganic particle to the surface of the toner particle is 80% or more. The aspect ratio of the toner is 0.90 or more. Where a contact pressure of a regulating member, which regulates the developer on the developer bearing member, against the developer bearing member is denoted by N (gf/mm) and a contact pressure of the supplying member, which is in contact with the developer bearing member and supplies the developer to developer bearing member, against the developer bearing member is denoted by D (gf/mm), the following expressions are satisfied: $D+2\times N-6\geq 0$, $1.5\leq N\leq 4.0$, and $2.0\leq D\leq 3.5$.

16 Claims, 9 Drawing Sheets

(56) References Cited

U.S. PATENT DOCUMENTS

| | | | | |
|---|---|---|---|---|
| 2003/0219285 | A1* | 11/2003 | Nakagawa | G03G 15/081 399/281 |
| 2006/0171746 | A1* | 8/2006 | Goto | G03G 15/0812 399/284 |
| 2007/0098459 | A1* | 5/2007 | Endo | G03G 15/065 399/281 |
| 2009/0117481 | A1 | 5/2009 | Yasunaga | |
| 2015/0362858 | A1* | 12/2015 | Sato | G03G 15/0815 399/284 |
| 2018/0246430 | A1* | 8/2018 | Tanaka | G03G 9/09725 |
| 2019/0041763 | A1* | 2/2019 | Tsuda | G03G 9/08797 |
| 2020/0064751 | A1* | 2/2020 | Murayama | G03G 9/08708 |

OTHER PUBLICATIONS

Extended European Search Report issued in European Application No. 19208483.8 dated Mar. 23, 2020.

* cited by examiner

DEVELOPING DEVICE, PROCESS CARTRIDGE, AND IMAGE FORMING APPARATUS

BACKGROUND OF THE INVENTION

Field of the Invention

The present invention relates to an image forming apparatus such as a copying machine, a printer, and a facsimile machine using an electrophotographic method, and more particularly to a developing device and a process cartridge that are adapted to the image forming apparatus.

Description of the Related Art

In an image forming apparatus such as a copying machine, a printer, or a facsimile machine that forms an image on a recording material using an electrophotographic image forming method (electrophotographic process), an electrostatic image is formed on an electrophotographic photosensitive member as an image bearing member in the image forming step, and the electrostatic image is developed using a developer. The developing device responsible for a developing step in the image forming step may be configured to be detachably attachable to the apparatus main body of the image forming apparatus as an independent unit or as a part of a process cartridge. The developing device includes a frame that is called a developing container or the like and accommodates a toner as a developer, and a developing roller that is rotatably disposed in the opening of the frame and serves as a developer bearing member that bears and conveys the toner from the inside of the frame body to the outside by rotating. The developing device further includes a toner supply roller as a supplying member that supplies the toner to the developing roller, and a developing blade as a regulation member that contacts the developing roller surface to regulate the amount of the toner borne by the developing roller and passing through the opening.

A method of forming an image using an electrophotographic process is currently used in various fields, and improvement in performance such as a higher speed and a higher image quality is demanded. In order to achieve both a higher speed and a higher image quality, it is necessary to increase the charge quantity of the toner and maintain the charge quantity of the toner throughout the life thereof.

Here, since the main charging means of the toner is based on friction, where the friction resistance of the toner is improved, the shear (friction opportunity and frictional force) with the charging member can be increased, leading to an increase in the charge quantity of the toner.

Here, as a toner excellent in development durability and storage stability, Japanese Patent Application Publication No. 2006-146056 discloses a toner in which inorganic particles are externally added to the toner surface to obtain a toner excellent in high-temperature storage stability and printing durability in a normal-temperature normal-humidity environment or a high-temperature high-humidity environment at the time of printing.

SUMMARY OF THE INVENTION

However, it has been found that even with the toner having excellent development durability as described above, the toner may not be durable under certain process conditions.

An object of the present invention is to suppress the occurrence of density unevenness due to potential unevenness by maintaining high charging performance of the developer over a long period of time while increasing the shear applied to the toner.

In order to achieve the above object, the developing device of the present invention comprises:

a developer bearing member that bears a developer on a surface thereof;

a supplying member that contacts the surface of the developer bearing member and supplies the developer to the surface of the developer bearing member; and a regulating member that contacts the surface of the developer bearing member and regulates the developer borne on the surface of the developer bearing member, wherein the developer includes a toner having a toner particle and an inorganic particle present on a surface of the toner particle;

a fixing ratio of the inorganic particle to the surface of the toner particle is 80% or more;

an aspect ratio of the toner is 0.90 or more;

wherein a contact pressure of the regulating member against the surface of the developer bearing member is denoted by N (gf/mm) and a contact pressure of the supplying member against the surface of the developer bearing member is denoted by D (gf/mm), the following expressions are satisfied:

$$D+2\times N-6\geq 0,$$

$$1.5\leq N\leq 4.0, \text{ and}$$

$$2.0\leq D\leq 3.5.$$

In order to achieve the above object, the process cartridge of the present invention comprises:

the developing device of the present invention; and an image bearing member on which an electrostatic latent image, to be developed by the developing device, is formed, wherein the process cartridge is capable of being detachably attached to a main body of an image forming apparatus.

In order to achieve the above object, the image forming apparatus of the present invention comprises:

the developing device of the present invention; and an image bearing member on which an electrostatic latent image, to be developed by the developing device, is formed.

According to the present invention, high charging performance of the developer can be maintained over a long period of time, and the density change due to the potential fluctuation is reduced, so that the occurrence of density unevenness due to potential unevenness can be suppressed.

Further features of the present invention will become apparent from the following description of exemplary embodiments with reference to the attached drawings.

DESCRIPTION OF THE EMBODIMENTS

Figure 1:
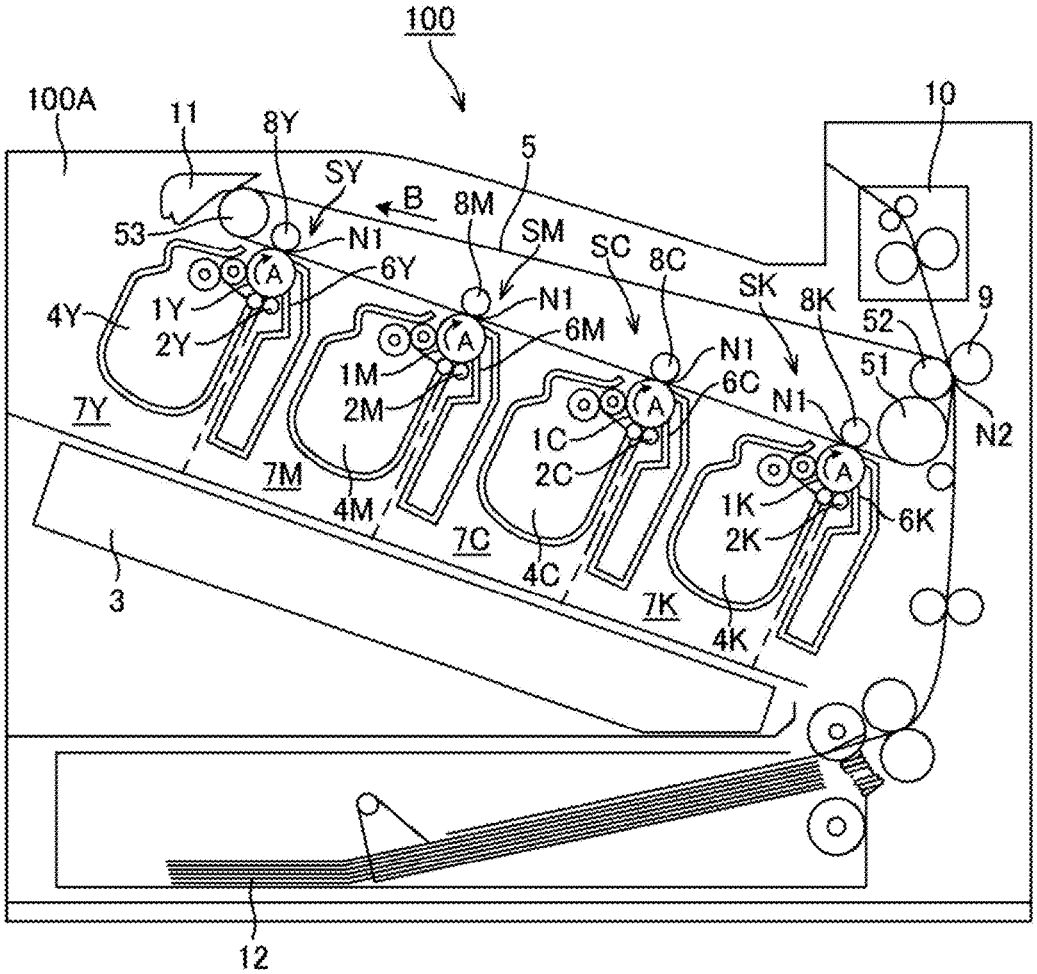
FIG. 1 is a schematic sectional view of an image forming apparatus according to an embodiment.

In the present invention, the description of "at least XX and not more than YY" or "XX to YY" representing a numerical range means a numerical range including a lower limit and an upper limit as end points unless otherwise specified.

The developer of the present invention has a toner particle and inorganic particles present on the surface of the toner particle.

The toner particle may include a binder resin. Examples of the binder resin include polyester resin, vinyl resin, epoxy resin, and polyurethane resin.

The polyester resin may be produced using a generally known method of condensation polymerization of an alcohol component and an acid component.

The vinyl resin may be produced by polymerization of a polymerizable monomer such as styrene and derivatives thereof; an unsaturated monoolefin; an unsaturated polyene; an α-methylene aliphatic monocarboxylic acid ester; an acrylic acid ester; a vinyl ketone; an acrylic acid or methacrylic acid derivative such as acrylonitrile, methacrylonitrile, and acrylamide, and the like.

The toner particles may include a release agent. The release agent is not limited as long as the releasability can be improved, and examples thereof include the following.

Aliphatic hydrocarbon waxes such as polyolefin copolymer, polyolefin wax, microcrystalline wax, paraffin wax, Fischer-Tropsch wax.

The amount of the release agent is preferably at least 1.0 part by mass and not more than 30.0 parts by mass, and more preferably at least 5.0 parts by mass and not more than 25.0 parts by mass with respect to 100.0 parts by mass of the binder resin or the polymerizable monomer that generates the binder resin.

The toner of the present invention can be used as either a magnetic one-component toner or a non-magnetic one-component toner, but is preferably a non-magnetic one-component toner.

Examples of colorants used in the case of a non-magnetic one-component toner include various conventionally known dyes and pigments.

Examples of black colorants include carbon black or those that are toned in black using the yellow, magenta, and cyan colorants described below.

Examples of yellow colorants include monoazo compounds, disazo compounds, condensed azo compounds, isoindolinone compounds, anthraquinone compounds, azo metal complexes, methine compounds, and allylamide compounds.

Examples of magenta colorants include monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Examples of cyan colorants include copper phthalocyanine compounds and derivatives thereof, anthraquinone compounds, basic dye lake compounds, and the like.

The amount of the colorant is preferably at least 1.0 part by mass and not more than 20.0 parts by mass with respect to 100.0 parts by mass of the binder resin or the polymerizable monomer that generates the binder resin.

Examples of the inorganic particles used in the present invention include silica fine particles, titanium oxide fine particles, magnesium oxide fine particles, strontium titanate fine particles, alumina fine particles, zinc oxide fine particles, cerium oxide fine particles, calcium carbonate fine particles and the like. Two or more selected from any combination of these fine particle groups can also be used.

Among these, the inorganic particles are preferably fine particles of at least one type selected from the group consisting of silica fine particles, titanium oxide fine particles, magnesium oxide fine particles, strontium titanate fine particles, and alumina fine particles.

The inorganic particles may be hydrophobized with a hydrophobizing agent such as a silane coupling agent, silicone oil, or a mixture thereof.

The number average particle diameter (D1) of primary particles of the inorganic particles is preferably 5 nm or more, 10 nm or more, 15 nm or more, 20 nm or more, and 25 nm or more, and 500 nm or less, 400 nm or less, 300 nm or less, 250 nm or less, and 200 nm or less. The numerical ranges can be arbitrarily combined.

The amount of the inorganic particles is preferably at least 0.1 parts by mass and not more than 10.0 parts by mass, and more preferably at least 1.0 parts by mass and not more than 5.0 parts by mass with respect to 100.0 parts by mass of the toner particles.

Method for Measuring Number Average Particle Diameter (D1) of Primary Particles of Inorganic Particles The number average particle diameter of the primary particles of the inorganic particles is obtained by observing the inorganic particles present on the toner particle surface with a scanning electron microscope. As the scanning electron microscope, Hitachi ultra-high-resolution field-emission scanning electron microscope S-4800 (manufactured by Hitachi, Ltd.) is used. The image capturing conditions of S-4800 are as follows. Elemental analysis is performed in advance using an energy dispersive X-ray analyzer (manufactured by EDAX), and measurement is performed after confirming the composition of each particle, such as silica fine particles, titanium oxide fine particles, and alumina fine particles.

(1) Sample Preparation

A thin layer of conductive paste is coated on a sample table (aluminum sample table 15 mm×6 mm) and a toner is sprayed thereon. Further, air is blown to remove excess toner from the sample stage and perform sufficient drying. The sample stage is set on the sample holder, and the height of the sample stage is adjusted to 36 mm by a sample height gauge.

(2) S-4800 Observation Condition Setting

The calculation of the number average particle diameter of the primary particles of the inorganic particles is performed using an image obtained by observation of the reflected electron image of S-4800. Since the reflected electron image has less charge-up of the inorganic particle than the secondary electron image, the particle diameter of the inorganic particle can be measured with high accuracy.

Liquid nitrogen is poured into an anti-contamination trap attached to the S-4800 housing until the nitrogen overflows, and allowed to stand for 30 min. "PCSTEM" of S-4800 is activated and flashing (cleaning of the FE chip as an electron source) is performed. An acceleration voltage display portion of the control panel on the screen is clicked and the "FLASHING" button is pushed to open the flashing execution dialog.

The flashing is executed after confirming that the flashing strength is 2. The emission current due to flashing is confirmed to be 20 μA to 40 μA. The sample holder is inserted into the sample chamber of the S-4800 housing. The "ORIGIN POINT" on the control panel is pushed and the sample holder is moved to the observation position.

The acceleration voltage display portion is clicked to open an HV setting dialog, the acceleration voltage is set to "0.8 kV", and the emission current is set to "20 μA". In the "BASIC" tab of the operation panel, the signal selection is set to "SE", "UP (U)" and "+BSE" are selected for an SE detector, and "L. A. 100" is selected in the selection box on the right side of "+BSE" to select a mode in which observation is performed with a reflected electron image.

Similarly, in the "BASIC" tab of the operation panel, the probe current of an electron optical system condition block is set to "Normal", the focus mode is set to "UHR", and WD is set to "3.0 mm". The "ON" button in the acceleration voltage display portion of the control panel is pushed to apply the acceleration voltage.

(3) Calculation of Number Average Particle Diameter (D1) of Inorganic Particles

The magnification is set to 100,000 (100 k) by dragging in the magnification display portion of the control panel. The focus knob "COARSE" on the operation panel is rotated, and the aperture alignment is adjusted when the focus is achieved to some extent. "Align" is clicked on the control panel to display the alignment dialog and select "BEAM". The STIGMA/ALIGNMENT knob (X, Y) on the operation panel is rotated to move the displayed beam to the center of the concentric circles.

Next, "APERTURE" is selected and the STIGMA/ALIGNMENT knob (X, Y) is turned one by one to stop the movement of the image or adjust it to the minimum movement. The aperture dialog is closed and focusing is performed with auto focus. This operation is repeated two more times to focus.

The particle diameter of at least 300 inorganic particles on the toner particle surface is measured to determine the average particle diameter. Here, since some inorganic particles are present as aggregates in some of external addition methods, the maximum diameter of what can be confirmed as primary particles is obtained, and the obtained maximum diameter is arithmetically averaged to obtain the number average particle diameter (D1) of primary particles of the inorganic particles.

Method for Producing Toner Particles

As a method for producing toner particles, known means can be used, and a kneading and pulverizing method or a wet production method can be used. From the viewpoint of uniform particle diameter and shape controllability, a wet production method can be preferably used. Furthermore, examples of the wet production method include a suspension polymerization method, a dissolution suspension method, an emulsion polymerization aggregation method, and an emulsion aggregation method.

Here, the suspension polymerization method will be described. In the suspension polymerization method, first, a polymerizable monomer for producing a binder resin, a colorant, and, if necessary, other additives are uniformly dissolved or dispersed using a disperser such as a ball mill, an ultrasonic disperser or the like to prepare a polymerizable monomer composition (step of preparing a polymerizable monomer composition). At this time, a polyfunctional monomer, a chain transfer agent, a wax as a release agent, a charge control agent, a plasticizer, and the like can be added as necessary.

Next, the polymerizable monomer composition is put into an aqueous medium prepared in advance, and droplets made of the polymerizable monomer composition are formed into toner particles of desired size by using a stirrer or a disperser having a high shearing force (granulation step).

It is preferable that the aqueous medium in the granulation step include a dispersion stabilizer in order to control the particle diameter of the toner particles, sharpen the particle size distribution, and suppress coalescence of the toner particles in the production process. Dispersion stabilizers are generally roughly classified into polymers that develop a repulsive force due to steric hindrance and poorly water-soluble inorganic compounds that achieve dispersion stabilization with an electrostatic repulsive force. The fine particles of the poorly water-soluble inorganic compound are preferably used because they are dissolved by an acid or an alkali and can be easily dissolved and removed by washing with an acid or an alkali after polymerization.

After the granulation step or while performing the granulation step, the temperature is preferably set to at least 50° C. and not more than 90° C. to polymerize the polymerizable monomer contained in the polymerizable monomer composition, and toner particle-dispersed solution obtained (polymerization step).

In the polymerization step, it is preferable to perform a stirring operation so that the temperature distribution in the container is uniform. Where a polymerization initiator is added, the addition can be performed at arbitrary timing and for a required time. In addition, the temperature may be raised in the latter half of the polymerization reaction for the purpose of obtaining a desired molecular weight distribution. Furthermore, in order to remove the unreacted polymerizable monomer and by-products from the system, part of the aqueous medium may be removed by distillation in the latter half of the reaction or after completion of the reaction. The distillation operation can be performed under normal or reduced pressure.

From the viewpoint of obtaining a high-definition and high-resolution image, the toner preferably has a weight average particle diameter of at least 3.0 μm and not more than 10.0 μm. The weight average particle diameter of the toner can be measured by a pore electric resistance method. The measurement can be performed, for example, by using "Coulter Counter Multisizer 3" (manufactured by Beckman Coulter, Inc.). The toner particle-dispersed solution thus obtained is sent to a filtration step for solid-liquid separation of the toner particles and the aqueous medium.

The solid-liquid separation for obtaining toner particles from the obtained toner particle-dispersed solution can be carried out by a general filtration method. Thereafter, in order to remove foreign matter that could not be removed from the toner particle, it is preferable to perform reslurrying or further washing with running washing water or the like. After sufficient washing, solid-liquid separation is performed again to obtain a toner cake. Thereafter, the toner cake is dried by a known drying unit, and if necessary, a particle group having a particle diameter outside the predetermined range is separated by classification to obtain toner particles. The separated particles having a particle diameter outside the predetermined range may be reused to improve the final yield.

Method for Externally Adding Inorganic Particles to Toner Particle

In the above step, inorganic particles are added to the manufactured toner particle for the purpose of improving flowability, charging characteristics, high durability and the like. For example, the toner particles and the inorganic particles may be put into a mixing device, which is equipped with blades that rotates at high speed, and sufficiently mixed.

The inorganic particles present on the surface of the toner particle and the toner particles are preferably in contact with each other without any gap. As a result, the occurrence of bleeding of the resin component and the release agent located inside the toner particle from the surface layer of the toner particle is suppressed, and a toner having excellent storage stability, environmental stability, and development durability can be obtained.

In the present invention, the fixing ratio of the inorganic particles to the surface of the toner particle is 80% or more, and preferably 85% or more and 90% or more. The fixing ratio is preferably 100% or less. The abovementioned numerical ranges can be arbitrarily combined.

When the fixing ratio is in the above range, toner fusion to the developing blade or the developing roller is prevented, and development streaks can be suppressed. In addition, it is possible to withstand the shear created with the charge imparting member, the toner charge quantity is maintained, and density unevenness and dropout due to potential unevenness can be suppressed.

The fixing ratio can be adjusted to the above range by increasing or decreasing the impact force or shearing force due to high-speed contact in the mixture of toner particles and inorganic particles.

In the present invention, the coverage of the inorganic particles on the surface of the toner particle is preferably 80% or more, 85% or more, and 90% or more, and also preferably 100% or less. The abovementioned numerical ranges can be arbitrarily combined.

When the coverage is in the above range, toner fusion to the developing blade and the developing roller is easily prevented, and development streaks are more easily suppressed. In addition, it becomes easier to withstand the shear created with the charge imparting member, the toner charge quantity is maintained, and it is easier to suppress density unevenness and dropout due to potential unevenness.

In addition, the coverage can be adjusted to the above-mentioned range by the addition amount of an inorganic particles.

Method for Measuring Adhesion Ratio of Inorganic Particles to Surface of Toner Particle (1) Sample Preparation Pre-washing toner: various toners prepared in the embodiment are used as they are.

Post-washing toner: 20 g of "CONTAMINON N" (2% by mass aqueous solution of a neutral detergent with a pH of 7 for washing precision measuring instruments; includes a nonionic surfactant, an anionic surfactant and an organic builder) is weighed and mixed with 1 g of toner in a vial having a capacity of 50 mL. The vial is set in "KM Shaker" (model: V. SX) manufactured by Iwaki Sangyo Co., Ltd., a speed is set to 50, and the vial is shaken for 30 sec. Thereafter, the toner and the aqueous solution are separated by a centrifugal separator (1000 rpm for 5 min). The supernatant is separated and the precipitated toner is dried by vacuum drying.

External additive-removed toner: The external additive-removed toner means a state in which an external additive that can be freed in this test has been removed. In the sample preparation method, the toner is put in isopropanol which does not dissolve the toner, and vibration is applied for 10 min by an ultrasonic cleaner. Thereafter, the toner and the solution are separated by a centrifugal separator (1000 rpm for 5 min). The supernatant is separated and the precipitated toner is dried by vacuum drying.

(2) Measurement of Adhesion Ratio

The inorganic particles are quantified and the degree of freeing is obtained by measuring the intensity of each element derived from the inorganic particles by wavelength dispersion type fluorescent X-ray analysis (XRF) for the above-mentioned pre-washing toner, post-washing toner, and external additive-removed toner.

(i) Examples of Devices Used

X-ray fluorescence analyzer 3080 (Rigaku Corporation)

Sample press molding machine MAEKAWA Testing Machine (manufactured by MFG Co., Ltd.)

(ii) Measurement Conditions

| | |
|---|---|
| Measurement potential, voltage | 50 kV, 50 to 70 mA |
| 2θ angle | a |
| Crystal plate | LiF |
| Measurement time | 60 sec |

(iii) Method for Calculating Adhesion Ratio to Surface of Toner Particle

First, the intensity of each element derived from the inorganic particles in the pre-washing toner, post-washing toner and external additive-removed toner is determined by the above method. Thereafter, the fixing ratio of the inorganic particles to the surface of the toner particle is calculated based on the following formula.

[Formula] Fixing ratio of inorganic particles (%)=[(Intensity of elements derived from inorganic particles of post-washing toner)−(Intensity of elements derived from inorganic particles of external additive-removed toner)]/[(Intensity of elements derived from inorganic particles of pre-washing toner)−(Intensity of elements derived from inorganic particles of external additive-removed toner)]×100

Method for Measuring Coverage of Surface of Toner Particle with Inorganic Particles The coverage of the surface of the toner particle with the inorganic particles is calculated by analyzing the image of the toner particle surface captured by Hitachi ultra-high-resolution field-emission scanning electron microscope S-4800 (manufactured by Hitachi High-Technologies Corporation) with image analyzing software Image-Pro Plus ver. 5.0 (manufactured by Nippon Roper K.K.). The image capturing conditions of S-4800 are as follows.

(1) Sample Preparation

A thin layer of conductive paste is coated on a sample table (aluminum sample table 15 mm×6 mm) and a toner is sprayed thereon. Further, air is blown to remove excess toner from the sample stage and perform sufficient drying. The sample stage is set on the sample holder, and the height of the sample stage is adjusted to 36 mm by a sample height gauge.

(2) S-4800 Observation Condition Setting

The calculation of the coverage is performed using an image obtained by observation of the reflected electron image of S-4800. Since the reflected electron image has less charge-up of the inorganic particle than the secondary electron image, the coverage can be measured with high accuracy.

Liquid nitrogen is poured into an anti-contamination trap attached to the S-4800 housing until the nitrogen overflows, and allowed to stand for 30 min. "PC-SEM" of S-4800 is activated and flashing (cleaning of the FE chip as an electron source) is performed. An acceleration voltage display portion of the control panel on the screen is clicked and the "FLASHING" button is pushed to open the flashing execution dialog. The flashing is executed after confirming that the flashing strength is 2. The emission current due to flashing is confirmed to be 20 μA to 40 μA. The sample holder is inserted into the sample chamber of the S-4800 housing. The "ORIGIN POINT" on the control panel is pushed and the sample holder is moved to the observation position.

The acceleration voltage display portion is clicked to open an HV setting dialog, the acceleration voltage is set to "0.8 kV", and the emission current is set to "20 μA". In the "BASIC" tab of the operation panel, the signal selection is set to "SE", "UP (U)" and "+BSE" are selected for an SE detector, and "L. A. 100" is selected in the selection box on the right side of "+BSE" to select a mode in which observation is performed with a reflected electron image. Similarly, in the "BASIC" tab of the operation panel, the probe current of an electron optical system condition block is set to "Normal", the focus mode is set to "UHR", and WD is set to "3.0 mm". The "ON" button in the acceleration voltage display portion of the control panel is pushed to apply the acceleration voltage.

(3) Calculation of Number Average Particle Diameter (D1) of Toner

The magnification is set to 5000 (5 k) by dragging in the magnification display portion of the control panel. The focus knob "COARSE" on the operation panel is rotated, and the aperture alignment is adjusted when the focus is achieved to some extent. "Align" is clicked on the control panel to display the alignment dialog and select "BEAM". The STIGMA/ALIGNMENT knob (X, Y) on the operation panel is rotated to move the displayed beam to the center of the concentric circles.

Next, "APERTURE" is selected and the STIGMA/ALIGNMENT knob (X, Y) is turned one by one to stop the movement of the image or adjust it to the minimum movement. The aperture dialog is closed and focusing is performed with auto focus. This operation is repeated two more times to focus.

The particle diameter of 300 toner particles is measured to determine the number average particle diameter (D1). The particle diameter of each particle is the maximum diameter when the toner particles are observed.

(4) Focus Adjustment

For the particles with a diameter within ±0.1 μm of the number average particle diameter (D1) obtained in (3), the magnification is set to 10,000 (10 k) by dragging in the magnification display portion of the control panel with the midpoint of the maximum diameter aligned with the center of the measurement screen. The focus knob "COARSE" on the operation panel is rotated, and the aperture alignment is adjusted when the focus is achieved to some extent. "Align" is clicked on the control panel to display the alignment dialog and select "BEAM". The STIGMA/ALIGNMENT knob (X, Y) on the operation panel is rotated to move the displayed beam to the center of the concentric circles. Next, "APERTURE" is selected and the STIGMA/ALIGNMENT knob (X, Y) is turned one by one to stop the movement of the image or adjust it to the minimum movement. The aperture dialog is closed and focusing is performed with auto focus. Thereafter, the magnification is set to 50,000 (50 k), focus adjustment is performed using the focus knob and the STIGMA/ALIGNMENT knob as described above, and then focusing is performed again with auto focus. This operation is repeated to focus. Here, since the measurement accuracy of the coverage tends to be low when the angle of inclination of the observation surface is large, analysis is performed by selecting the configuration with the smallest possible surface inclination by selecting the configuration in which focusing is performed on the entire observation surface at the same time when adjusting the focus.

(5) Image Storage

Brightness is adjusted in an ABC mode, and an image is captured with a size of 1280×960 pixels and saved. The following analysis is performed using this image file. One image is captured for each toner particle, and an image is obtained for 30 or more toner particles.

(6) Image Analysis

In the present invention, the coverage is calculated by binarizing the images obtained by the above-described method using the following analysis software. At this time, the one screen is divided into 12 squares and each square is analyzed.

The analysis conditions of image analysis software Image-Pro Plus ver. 5.0 are as follows.

"COUNT"/"SIZE" and "OPTIONS" are sequentially selected from "MEASUREMENT" in the toolbar, and the binarization condition is set. Then, 8 connections are selected in the object extraction option and smoothing is set to 0. In addition, sorting, filling holes, and inclusion lines are not selected, and "EXCLUDE BOUNDARY LINES" is set to "NONE".

"MEASUREMENT ITEM" is selected from "SELECT" on the toolbar, and 2 to $10^7$ is inputted in the area selection range.

When calculating the coverage, analysis is performed by surrounding a square region. At this time, the area (C) of the region is set to 24,000 pixels to 26,000 pixels. Automatic binarization is set in "PROCESSING"—by binarization, and the sum total (D) of the areas of the regions without inorganic particles is calculated.

From the area C of the square region and the sum total D of the areas of the regions without inorganic particles, the coverage of the inorganic particles is obtained by the following formula.

$$\text{Coverage of inorganic particle (\%)} = 100 - (D/C \times 100)$$

The above-described calculation of the coverage is performed for 30 or more toner particles. The arithmetic average value of all the obtained data is taken as the coverage (%) of the surface of the toner particle by the inorganic particles in the present invention.

In the present invention, the aspect ratio of the toner is 0.90 or more, and preferably 0.91 or more, 0.92 or more, 0.94 or more, or 0.95 or more. The aspect ratio is preferably 1.00 or less. The numerical ranges can be combined arbitrarily.

When the aspect ratio is in the above range, the uniformity of the diffusion and adhesion of the inorganic particles on the toner particle surface is improved, and the toner can easily maintain a point contact state via the inorganic particles. Furthermore, the flowability of the toner itself is improved, and the charging characteristics can be promoted due to satisfactory rolling.

The aspect ratio can be adjusted within the above range by appropriately classifying or adding a surface treatment in the toner particle production step.

The aspect ratio of the toner is an index indicating the ratio (short side/long side) of the minimum length to the maximum length when the toner is projected. The closer the aspect ratio is to 1.00, the closer to a true sphere.

The aspect ratio of the toner in the present invention is determined by performing operations (1) to (6) in the same manner as in "Method for Measuring Coverage of Inorganic Particles on Surface of Toner Particle", and measuring the maximum length of the toner with the scanning electron microscope. Further, the minimum length is selected from the measurement commands, and the value thereof is obtained. Then, the ratio of the minimum length to the maximum length is calculated and taken as the aspect ratio. The arithmetic average value of 100 obtained toner particles is taken as the aspect ratio of the toner of the present invention.

Measurement of Amount of Inorganic Particles in Toner

The amount of the inorganic particles is measured using a wavelength dispersive X-ray fluorescence analyzer "Axios" (manufactured by PANalytical) and dedicated software "SuperQ ver. 4.0F" (manufactured by PANalytical) provided therewith for setting measurement conditions and analyzing measurement data.

Further, Rh is used as the anode of the X-ray tube, the measurement atmosphere is vacuum, the measurement diameter (collimator mask diameter) is 27 mm, and the measurement time is 10 sec. When measuring a light element, the element is detected by a proportional counter (PC), and when measuring a heavy element, the element is detected by a scintillation counter (SC).

A pellet prepared by placing 4 g of toner particles in a dedicated aluminum ring for pressing and molding to a thickness of 2 mm and a diameter of 39 mm by pressing for 60 sec under 20 MPa with a tablet molding compressor "BRE-32" (manufactured by Maekawa Test Instruments Co., Ltd.) is used as a measurement sample.

Silica ($SiO_2$) fine powder is added to constitute 0.5 parts by mass with respect to 100 parts by mass of toner particles not containing the inorganic particles, and sufficient mixing is performed using a coffee mill. Similarly, the silica fine powder is mixed with the toner particles so as to constitute 5.0 parts by mass and 10.0 parts by mass, respectively, and these are used as samples for a calibration curve.

For each sample, the pellet of the sample for a calibration curve is prepared as described above using a tablet molding compressor, and a count rate (unit: cps) of Si-Kα rays observed at a diffraction angle (2θ) of 109.08° when using PET as a spectroscopic crystal is measured. At this time, the acceleration voltage and current value of the X-ray generator are set to 24 kV and 100 mA, respectively. A calibration curve in the form of a linear function is obtained by plotting the obtained X-ray count rate on the ordinate and plotting the added amount of $SiO_2$ in each sample for a calibration curve on the abscissa.

Next, the toner to be analyzed is pelletized as described above using the tablet molding compressor, and the count rate of the Si—Kα rays is measured. Then, the amount of the organosilicon polymer in the toner particle is determined from the above calibration curve. In the case of titanium oxide fine particles, magnesium oxide fine particles, strontium titanate fine particles, alumina fine particles, and the like, measurements may be performed by changing the sample for the calibration curve, the type of the spectroscopic crystal, and the diffraction angle to match each element.

Measurement of Particle Diameter of Toner (Particle)

A precision particle size distribution measuring device (trade name: Coulter Counter Multisizer 3) based on a pore electric resistance method and dedicated software (trade name: Beckman Coulter Multisizer 3, Version 3.51, manufactured by Beckman Coulter, Inc.) are used. The aperture diameter is 100 μm, the measurement is performed with 25,000 effective measurement channels, and the measurement data are analyzed and calculated. "ISOTON II" (trade name) manufactured by Beckman Coulter, Inc., which is a solution prepared by dissolving special grade sodium chloride in ion exchanged water to a concentration of about 1% by mass, can be used as the electrolytic aqueous solution for measurements. The dedicated software is set up in the following manner before the measurement and analysis.

The total count number in a control mode is set to 50,000 particles on a "CHANGE STANDARD MEASUREMENT METHOD (SOM) SCREEN" of the dedicated software, the number of measurements is set to 1, and a value obtained using (standard particles 10.0 μm, manufactured by Beckman Coulter, Inc.) is set as a Kd value. The threshold and the noise level are automatically set by pressing a measurement button of threshold/noise level. Further, the current is set to 1600 μA, the gain is set to 2, the electrolytic solution is set to ISOTON II (trade name), and flush of aperture tube after measurement is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set at least 2 μm and not more than 60 μm.

The specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "FLUSH OF APERTURE TUBE" function of the dedicated software.

(2) About 30 mL of the electrolytic aqueous solution is placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments, manufactured by Wako Pure Chemical Industries, Ltd.) with ion exchanged water is added thereto.

(3) A predetermined amount of ion exchanged water and about 2 mL of the CONTAMINON N (trade name) are added in the water tank of an ultrasonic disperser (trade name: Ultrasonic Dispersion System Tetora 150, manufactured by Nikkaki Bios Co., Ltd.) with an electrical output of 120 W in which two oscillators with an oscillation frequency of 50 kHz are built in with a phase shift of 180 degrees.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner (particles) is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature of at least 10° C. and not more than 40° C.

(6) The electrolytic aqueous solution of (5) hereinabove in which the toner (particles) is dispersed is dropped using a pipette into the round bottom beaker of (1) hereinabove which is set in the sample stand, and the measurement concentration is adjusted to be about 5%. Then, measurement is conducted until the number of particles to be measured reaches 50,000.

(7) The measurement data are analyzed with the dedicated software provided with the apparatus, and the weight average particle diameter (D4) is calculated. The "AVERAGE DIAMETER" on the analysis/volume statistical value (arithmetic mean) screen when the dedicated software is set to graph/volume % is the weight average particle diameter (D4). The "AVERAGE DIAMETER" on the analysis/number statistical value (arithmetic mean) screen when the dedicated software is set to graph/number % is the number average particle diameter (D1).

Method for Measuring Toner Transferability

From the initial state, the external additive tends to be released from or buried in the toner surface as the toner continues to be rubbed against the photosensitive drum, the developing roller and the developing blade.

In particular, in the latter half of the durability, the above-mentioned trend progresses and the toner transferability improves.

The transferability is measured by measuring the overall flow characteristics including various flowability impediment factors of the powder. That is, comprehensive analysis is an effective means for estimating the physical quantity to be obtained.

The transferability is measured by measuring the difference in the friction force+aggregation degree between toner particles, and measuring the surface state (interface state) that has a great influence on the flowability of the toner.

Figure 8A:
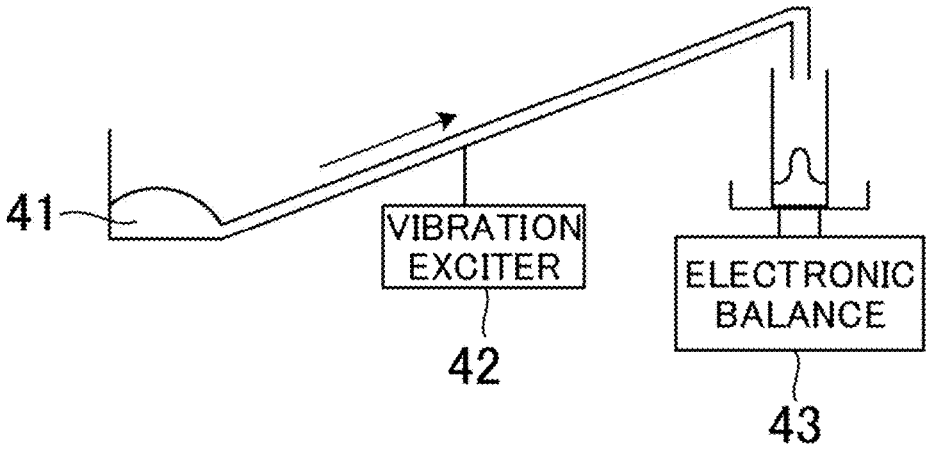
FIGS. 8A and 8B are explanatory diagrams of measurement of transferability.

FIG. 8A is a diagram showing the configuration of a transferability measuring device.

Approximately 1 g of the toner as a sample 41 is conveyed to a transfer table connected to a vibrator 42 and the toner conveying amount per unit time is measured with an electronic balance 43 or the like.

A device represented by a parts feeder or the like is used as the transfer table connected to the vibrator 42. The parts feeder is configured of a magnet and a leaf spring, and generates vibration by using a force generated by ON/OFF of the electromagnet and amplifying with the leaf spring. This vibration can be provided with directionality by adjusting the angle of the leaf spring, and the member (work) put in a "bowl" can be carried out in a certain direction. This time, the toner transferability can be measured by replacing the member with toner and conducting an experiment. As the transferability measuring device, an excitation transfer type flowability measuring device (manufactured by DIT Corporation) was used. The actual measurement conditions were as follows: the toner was allowed to stand at room temperature and normal humidity (25° C./50%) for one night to fully adjust to the environment, and then measurement was performed at an amplitude of 0.22 mm (P—P) and a frequency of 135 Hz.

Figure 8B:
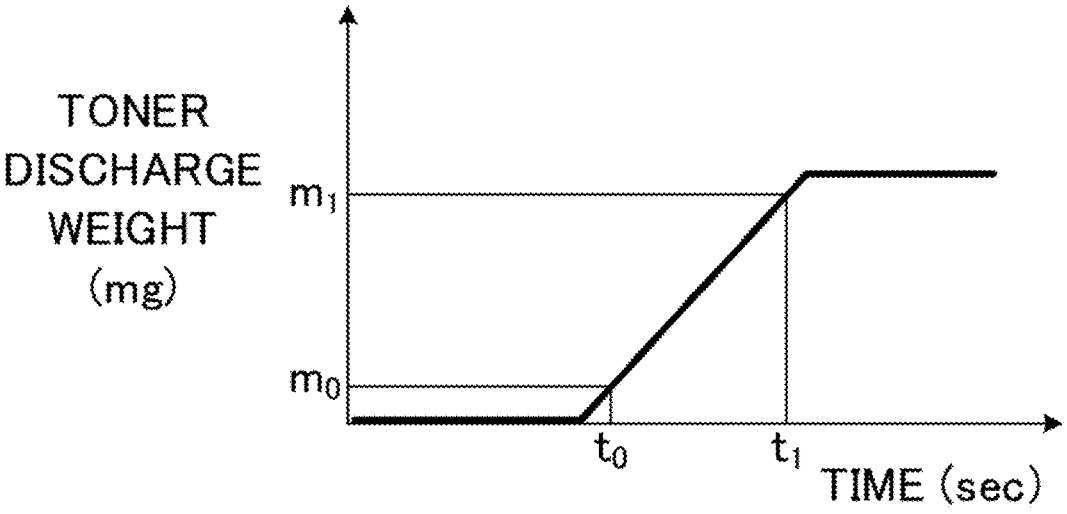

FIG. 8B is a diagram showing the toner discharge weight per unit time for measuring the transferability.

From this, transferability=discharged mass per unit time, which can be calculated as $(m_1-m_0)/(t_1-t_0)$ (mg/sec).

As a result, the above-mentioned trend is observed for the initial stage and the final stage of the toner.

Initially, since there are many external additives such as inorganic particles adhering to the toner, the interface state is good and the slipperiness is great, so the friction is lowered. Therefore, the flowability is high and the transferability tends to take a small value.

At the final stage of durability, external additives such as inorganic particles are freed and embedded, thereby increasing friction and lowering flowability, and the transferability tends to increase.

The transferability of the developer of the present invention is preferably less than 3 mg/sec.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

Overall Schematic Configuration of Image Forming Apparatus

An overall configuration of an electrophotographic image forming apparatus (hereinafter referred to as an image forming apparatus) according to an embodiment of the present invention will be described with reference to FIG. 1. FIG. 1 is a schematic cross-sectional view of an image forming apparatus 100 of the present embodiment. Examples of the image forming apparatus to which the present invention can be applied include a copying machine, a printer, a facsimile, machine and the like using an electrophotographic system. Here, a case where the present invention is applied to a laser printer will be described. The image forming apparatus 100 of the present embodiment is a full-color laser printer that employs an inline system and an intermediate transfer system. The image forming apparatus 100 can form a full-color image on a recording material (for example, recording paper, plastic sheet, cloth, and the like) according to the image information. The image information is inputted to an image forming apparatus main body 100A from an image reading device connected to the image forming apparatus main body 100A or from a host device such as a personal computer communicably connected to the image forming apparatus main body 100A.

The image forming apparatus 100 includes, as a plurality of image forming units, first, second, third and fourth image forming units SY, SM, SC, and SK for forming images of yellow (Y), magenta (M), cyan (C), and black (K) colors, respectively. In the present embodiment, the first to fourth image forming units SY, SM, SC, and SK are arranged in a line in a direction that intersects the vertical direction. In the present embodiment, the configurations and operations of the first to fourth image forming units SY, SM, SC, and SK are substantially the same except that the colors of images to be formed are different. Therefore, in the following general explanation, the symbols Y, M, C, and K given to the reference numerals to indicate that they are elements provided for a certain color are omitted, unless a specific unit needs to be identified.

In the present embodiment, the image forming apparatus 100 includes four drum-type electrophotographic photosensitive members, that is, the photosensitive drums 1, arranged in parallel in a direction intersecting the vertical direction as a plurality of image bearing members. The photosensitive drum 1 is rotationally driven in a direction indicated by an arrow A (clockwise) by a driving unit (drive source) (not shown). A charging roller 2 as a charging portion for uniformly charging the surface of the photosensitive drum 1, and a scanner unit (exposure device) 3 as an exposure portion for forming an electrostatic image (electrostatic latent image) on the photosensitive drum 1 by laser irradiation based on image information are disposed around the photosensitive drum 1. A developing unit (developing device) 4 as a developing portion for developing the electrostatic image as a toner image (developer image), and a cleaning member 6 as a cleaning portion for removing the untransferred toner remaining on the surface of the photosensitive drum 1 are also disposed around the photosensitive drum 1. Further, an intermediate transfer belt 5 as an intermediate transfer member for transferring the toner image on the photosensitive drum 1 to the recording material 12 is disposed above the photosensitive drum 1 so as to face the four photosensitive drums 1.

In the present embodiment, the developing unit 4 as a developing device uses the toner of a non-magnetic one-component developer as a developer. Further, in the present embodiment, the developing unit 4 performs reverse development by bringing a developing roller as a developer bearing member into contact with the photosensitive drum 1. That is, in the present embodiment, the developing unit 4 develops the electrostatic image by causing the toner charged to the same polarity (negative polarity in the present embodiment) as the charging polarity of the photosensitive drum 1 to adhere to a portion (image portion, exposed portion) in which the charge has been attenuated by exposure on the photosensitive drum 1.

In the present embodiment, the photosensitive drum 1 and the charging roller 2, the developing unit 4 and the cleaning member 6 as process unit acting on the photosensitive drum 1 are integrated, that is, integrated into a cartridge to form a process cartridge 7. The process cartridge 7 can be attached to and detached from the image forming apparatus 100 by a mounting portion such as a mounting guide and a positioning member provided at the image forming apparatus main body 100A. In the present embodiment, the process cartridges 7 for each color all have the same shape, and toners of yellow (Y), magenta (M), cyan (C), and black (K) colors are accommodated in process cartridges 7 of respective colors.

The intermediate transfer belt 5 formed of an endless belt as an intermediate transfer member contacts all the photosensitive drums 1 and circulates (rotates) in the direction of arrow B (counterclockwise) in the figure. The intermediate transfer belt 5 is wound around a driving roller 51, a secondary transfer counter roller 52, and a driven roller 53 as a plurality of support members. On the inner peripheral surface side of the intermediate transfer belt 5, four primary transfer rollers 8 serving as primary transfer units are arranged in parallel so as to face the respective photosensitive drums 1. The primary transfer roller 8 presses the intermediate transfer belt 5 toward the photosensitive drum 1 to form a primary transfer portion N1 where the intermediate transfer belt 5 and the photosensitive drum 1 are in contact with each other. A bias having a polarity opposite to the normal charging polarity of the toner is applied to the primary transfer roller 8 from a primary transfer bias power source (high-voltage power source) as a primary transfer bias applying unit (not shown). As a result, the toner image on the photosensitive drum 1 is transferred (primary transfer) onto the intermediate transfer belt 5.

Further, a secondary transfer roller 9 as a secondary transfer unit is disposed at a position facing the secondary transfer counter roller 52 on the outer peripheral surface side of the intermediate transfer belt 5. The secondary transfer roller 9 is pressed against the secondary transfer counter roller 52, with the intermediate transfer belt 5 being interposed therebetween, to form a secondary transfer portion N2 where the intermediate transfer belt 5 and the secondary transfer roller 9 come into contact. A bias having a polarity opposite to the normal charging polarity of the toner is applied to the secondary transfer roller 9 from a secondary transfer bias power source (high-voltage power source) as a secondary transfer bias applying unit (not shown). As a result, the toner image on the intermediate transfer belt 5 is transferred (secondary transfer) to the recording material 12.

More specifically, at the time of image formation, the surface of the photosensitive drum 1 is initially uniformly charged by the charging roller 2. Next, the surface of the charged photosensitive drum 1 is scanned and exposed by laser light corresponding to the image information generated from the scanner unit 3, and an electrostatic image corresponding to the image information is formed on the photosensitive drum 1. Next, the electrostatic image formed on the photosensitive drum 1 is developed as a toner image by the developing unit 4. The toner image formed on the photosensitive drum 1 is transferred (primary transfer) onto the intermediate transfer belt 5 by the action of the primary transfer roller 8.

For example, when a full-color image is formed, the above-described processes up to the primary transfer are sequentially performed in the first to fourth image forming units SY, SM, SC, and SK, and toner images of each color are primarily transferred in superposition with each other onto the intermediate transfer belt 5. Thereafter, a recording material 12 is conveyed to the secondary transfer portion N2 in synchronization with the movement of the intermediate transfer belt 5. The four color toner images on the intermediate transfer belt 5 are secondarily transferred onto the recording material 12 collectively by the action of the secondary transfer roller 9 that is in contact with the intermediate transfer belt 5 with the recording material 12 being interposed therebetween. The recording material 12 onto which the toner image has been transferred is conveyed to the fixing device 10 as a fixing unit. The toner image is fixed on the recording material 12 by applying heat and pressure to the recording material 12 in the fixing device 10. The recording material 12 on which the toner image is fixed is conveyed further downstream from the fixing device 10 and discharged outside the apparatus.

The primary untransferred toner remaining on the photosensitive drum 1 after the primary transfer process is removed and collected by the cleaning member 6. The secondary untransferred toner remaining on the intermediate transfer belt 5 after the secondary transfer process is cleaned by the intermediate transfer belt cleaning device 11. The image forming apparatus 100 can form a single-color or multi-color image using only one desired image forming unit or using only some (not all) image forming units.

Schematic Configuration of Process Cartridge

The overall configuration of the process cartridge 7 mounted on the image forming apparatus 100 of the present embodiment will be described with reference to FIG. 2. In the present embodiment, the configuration and operation of the process cartridge 7 for each color are substantially the same except for the type (color) of the accommodated toner.

Figure 2:
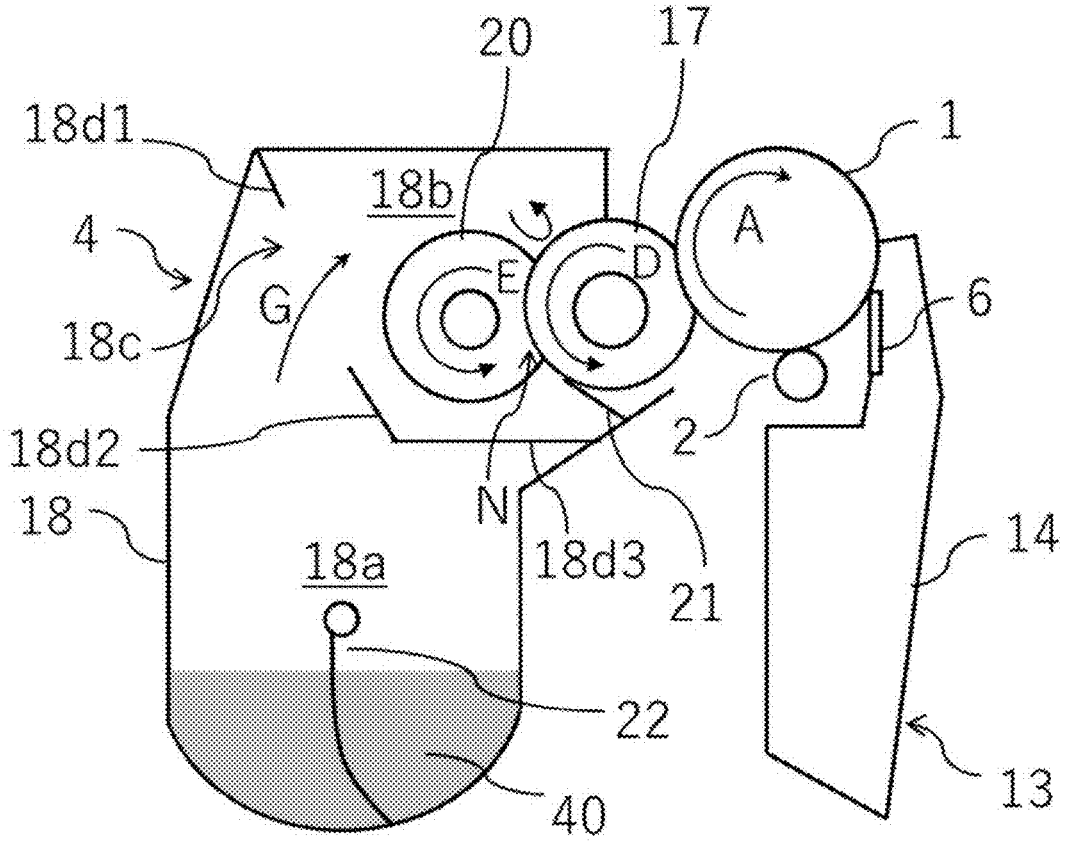
FIG. 2 is a schematic sectional view of a process cartridge according to the embodiment.

FIG. 2 is a schematic cross-sectional view (main cross-sectional view) of the process cartridge 7 of the present embodiment viewed along the longitudinal direction (rotational axis direction) of the photosensitive drum 1. The posture of the process cartridge 7 in FIG. 2 is that of the process cartridge attached to the image forming apparatus main body (posture at the time of use), and where when the positional relationship and direction of each member of the process cartridge are described hereinbelow, the positional relationship and direction in the posture are shown. That is, the up-down direction in FIG. 2 corresponds to the vertical direction, and the left-right direction corresponds to the horizontal direction. The setting of the arrangement configuration is based on the assumption that the image forming apparatus is installed on a horizontal plane as a normal installation state.

The process cartridge 7 is configured by integrating a photosensitive unit 13 having a photosensitive drum 1 and the like and a developing unit 4 having a developing roller 17 and the like. The photosensitive unit 13 has a cleaning frame 14 as a frame that supports various elements in the photosensitive unit 13. The photosensitive drum 1 is rotatably attached to the cleaning frame 14 by a bearing (not shown). The photosensitive drum 1 is rotationally driven in the direction of the arrow A (clockwise) in accordance with the image forming operation by transmitting the driving force of a driving motor (not shown) as a driving portion (driving source) to the photosensitive unit 13. In the present embodiment, the photosensitive drum 1 that is the most important component in the image forming process is an organic photosensitive drum 1 in which an outer surface of an aluminum cylinder is coated with an undercoat layer which is a functional film, a carrier generation layer, and a carrier transfer layer in this order.

Further, the cleaning member 6 and the charging roller 2 are disposed in the photosensitive unit 13 so as to be in contact with the peripheral surface of the photosensitive drum 1. The untransferred toner removed from the surface of the photosensitive drum 1 by the cleaning member 6 falls down and is accommodated in the cleaning frame 14. The charging roller 2 as a charging portion is driven to rotate by bringing the roller portion made of conductive rubber into pressure contact with the photosensitive drum 1. Here, as a charging step, a predetermined DC voltage, with respect to the photosensitive drum 1, is applied to the core of the charging roller 2, whereby a uniform dark portion potential (Vd) is formed on the surface of the photosensitive drum 1. A spot pattern of the laser beam emitted correspondingly to the image data by the laser beam from the scanner unit 3 described above exposes the photosensitive drum 1, and on the exposed portion, the charge on the surface is eliminated by the carrier from the carrier generation layer, and the potential drops. As a result, an electrostatic latent image with a predetermined light portion potential (V1) is formed at an exposed portion, and an electrostatic latent image with a predetermined dark portion potential (Vd) is formed at an unexposed portion on the photosensitive drum 1. In the present embodiment, Vd=−500 V and V1=−100 V.

Developing Unit

The developing unit 4 includes a developing roller 17, a developing blade 21, a toner supply roller 20, and a stirring and conveying member 22. The developing roller 17 serving as a developer bearing member bears the toner 40. The developing blade 21 serving as a regulating member regulates the toner 40 (layer thickness) borne on the developing roller 17. The toner supply roller 20 serving as a developer supplying member supplies the toner 40 to the developing roller 17. The stirring and conveying member 22 serving as a conveying member conveys the toner 40 to the toner supply roller 20. The developing unit 4 includes a developing container 18 as a frame on which the developing roller 17, the toner supply roller 20, and the stirring and conveying member 22 are rotatably assembled. The developing container 18 has a toner storage chamber 18*a* in which the stirring and conveying member 22 is disposed, a developing chamber 18*b* in which the developing roller 17 and the toner supply roller 20 are disposed, and a communication port 18*c* that communicates the toner storage chamber 18*a* and the developing chamber 18*b* with each other so as to enable the movement of the toner 40. The communication port 18*c* is provided in a partition wall portion 18*d* (18*d*1 to 18*d*3) that partitions the toner storage chamber 18*a* and the developing chamber 18*b*.

The partition wall portion 18*d* divides the internal space of the developing frame 18 into the toner storage chamber 18*a* and the developing chamber 18*b*. The partition wall portion 18*d* has a first wall portion 18*d*1 that partitions the internal space of the developing frame 18 above the communication port 18*c*, a second wall portion 18*d*2 that partitions the space below the communication port 18*c*, and a third wall portion 18*d*3 that is connected to the second wall portion 18*d*2 and partitions the space below the toner supply roller 20 and the developing roller 17. The first wall portion 18*d*1 and the second wall portion 18*d*2 extend in a direction inclined with respect to the vertical direction so that the opening direction of the communication port 18*c* from the toner storage chamber 18*a* toward the developing chamber 18*b* faces upward with respect to the horizontal direction. The communication port 18*c* opens in a region in the partition wall portion 18*d* on the side of the toner supply roller 20 opposite that of the developing roller 17 so as to face a space above the toner supply roller 20 in the developing chamber 18*b*. As a result, the internal space of the developing chamber 18*b* is configured so as to expand horizontally in the upward direction and so that the communication port 18*c* easily accepts the toner 40 that is lifted by the stirring and conveying member 22 from the lower side of the toner storage chamber 18*a* upward. The third wall portion 18*d*3 extends in a substantially horizontal direction from the lower end of the second wall portion 18*d*2 below the toner supply roller 20 and the developing roller 17. The third wall portion 18*d*3 and the second wall portion 18*d*2 form a configuration (a storage tank for the toner 40) such that receives the toner 40 spilled from the toner supply roller 20 and the developing roller 17 out of the toner 40 that has passed through the communication port 18*c*. The configuration composed of the second wall portion 18*d*2 and the third wall portion 18*d*3 is formed to extend from one side surface of the developing frame 18 to the other side surface in the longitudinal direction (the direction along the rotational axis of the developing roller 17 or the toner supply roller 20).

Here, the internal space of the developing chamber 18*b* is considered as being divided into a first space, a second space, and a third space. In FIGS. 8A and 8B, the first space is denoted by 51, the second space by S2, and the third space by S3.

The first space refers to a space above the nip portion N in the developing chamber 18*b*. More specifically, the first space is a spatial region above the nip portion N in the internal space of the developing chamber 18*b* where the peripheral surfaces of the toner supply roller 20 and the developing roller 17 and the inner wall portion surface of the developing chamber 18*b* face each other. The first space is surrounded by a region of the peripheral surfaces of the toner supply roller 20 and the developing roller 17 above the nip portion N, the inner wall portion surface of the developing chamber 18*b* facing these, and both longitudinal side surfaces of the developing chamber 18*b*.

The second space refers to a space provided in the developing chamber 18*b* so as to expand in the downstream direction of the rotation of the toner supply roller 20, with the narrow portion below the toner supply roller 20 serving as a boundary.

Here, the narrow portion refers to a portion where the gap between the third wall portion 18*d*3 of the wall portion 18*d* defining the internal space of the developing chamber 18*b* and the peripheral surface of the toner supply roller 20 is the narrowest in the region where the third wall portion and the peripheral surface of the toner supply roller face each other.

More specifically, the second space is a spatial region where the gap between the peripheral surface of the toner supply roller 20 and the third wall portion 18*d*3 gradually expands toward the downstream side in the rotation direction of the toner supply roller 20, with a narrow portion in the space between the toner supply roller 20 and the third wall portion 18*d*3 serving as a boundary. The second space is surrounded by the third wall portion 18*d*3, regions of the peripheral surfaces of the toner supply roller 20 and the developing roller 17 facing the third wall portion, the developing blade 21, and both longitudinal side surfaces of the developing chamber 18*b* on the downstream side in the rotation direction of the toner supply roller 20.

The third space refers to a space provided in the developing chamber 18*b* so that the space expands in the upstream direction of rotation of the toner supply roller 20, with the narrow portion serving as a boundary. More specifically, the third space is a spatial region where the gap between the peripheral surface of the toner supply roller 20 and the third wall portion 18*d*3 gradually increases toward the upstream side in the rotation direction, with a narrow portion serving as a boundary, in the space between the peripheral surface of the toner supply roller 20 and the third wall portion 18*d*3. The third space is surrounded by the second wall portion 18*d*2 and the third wall portion 18*d*3, a region of the peripheral surface of the toner supply roller 20 facing the two wall portions, and both longitudinal end surfaces of the developing chamber 18*b* upstream of the narrow portion in the rotation direction of the toner supply roller 20.

In the present embodiment, the second space is configured to be wider than the third space in the cross sections shown in FIGS. 2, 8A and 8B, etc.

The toner 40 lifted by the stirring and conveying member 22 is supplied above (first space) the nip portion N over the toner supply roller 20 because the upper end (the boundary with the lower end of the first wall portion 18*d*1) of the communication port 18*c* is disposed higher than the upper end of the toner supply roller 20. The toner 40 supplied above the nip portion N (first space) is sucked into the toner supply roller 20 (in the bubble cavities of the foam layer) by the deformation of the toner supply roller 20, moves counterclockwise (in the drawing) as the toner supply roller 20 rotates, and reaches the lower end of the nip portion N. Further, a part of the toner 40 lifted by the stirring and conveying member 22 and supplied to the surface of the toner supply roller 20 is partially returned to the toner storage chamber 18*a* by the rotation of the toner supply roller 20 in the arrow E direction. The remaining toner 40 is conveyed toward a region below the toner supply roller 20 (third space→second space).

When reaching the lower end of the nip portion N, the toner 40 is discharged from the inside of the toner supply roller 20 (the inside of the bubble cavities of the foam layer) by the deformation of the toner supply roller 20 and is supplied to the developing roller 17 while rubbing against the nip portion N. The toner 40 adhering to the developing roller 17 is regulated by the developing blade 21 and charged, and a uniform toner coat is formed on the developing roller 17 by the toner 40 that has passed through the regulating portion. Further, the toner 40 that remains without being developed in the developing portion is also scraped strongly by the surfaces of the toner supply roller 20 and the developing roller 17 rotating in opposite directions at the nip portion N. The toner 40 regulated by the developing blade 21 and detached from the developing roller 17 falls below (second space) the developing blade 21. Further, the toner 40 that has been discharged from the inside of the toner supply roller 20 and has not adhered to the developing roller 17 is discharged below (second space) the nip portion N.

When the above operation is repeated, the toner 40 is accumulated in the second space to form a compacted state of the toner 40. When the compacted state is formed, the toner 40 is supplied from the compacted portion to the surface of the toner supply roller 20 or inside thereof. Further, due to the formation of the compacted state, the toner 40 passes through the narrow portion and moves from the second space (compaction space) to the third space. Due to the pressure of the flow of the toner 40, a part of the toner 40 gets over the upper end of the second wall portion 18*d*2 below the communication port 18*c* and is returned to the toner storage chamber 18*a*.

Figure 9:
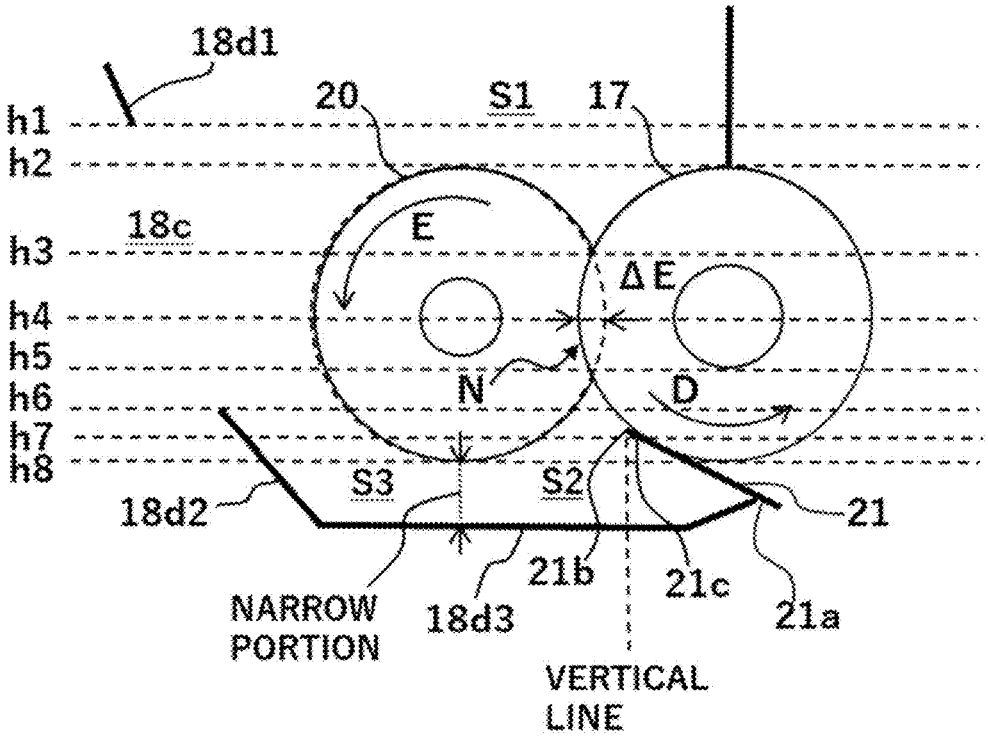
FIG. 9 is an explanatory diagram of an arrangement configuration of the process cartridge according to the embodiment.

Referring to FIG. 9, the details of the arrangement of each member in the developing chamber 18*b* of the present embodiment will be described. FIG. 9 is a schematic cross-sectional view illustrating the positional relationship of each member in the developing device according to the present embodiment.

In the present embodiment, (i) the upper end of the communication port 18*c* that separates the developing chamber 18*b* and the toner storage chamber 18*a* (the boundary between the first wall portion 18*d*1 and the communication port 18*c*) is disposed higher than the upper end of the toner supply roller 20. That is, as shown in FIG. 9, a horizontal line h1 passing through the upper end of the communication port 18*c* is located above a horizontal line h2 passing through the upper end of the toner supply roller 20.

Further, (ii) the center of the nip portion N (the center portion in the height direction or a position intersecting with a line connecting the rotation centers of the toner supply roller 20 and the developing roller 17) is disposed higher than the lower end of the communication port 18*c*, and the lower end of the nip portion N is disposed higher than the lower end of the communication port 18*c*. That is, as shown in FIG. 9, a horizontal line h4 passing through the center of the nip portion N is located above a horizontal line h6 passing through the lower end of the communication port 18*c* (the upper end of the second wall portion 18*d*2 (the boundary between the second wall portion 18*d*2 and the communication port 18*c*)). Further, a horizontal line h5 passing through the lower end of the nip portion N is located above the horizontal line h6 passing through the lower end of the communication port 18*c*.

Further, (iii) the lower end of the communication port 18*c* (the upper end of the second wall portion 18*d*2) is disposed higher than the end portion 21*b* at the contact position 21*c* between the developing blade 21 and the developing roller 17 on the upstream side in the rotation direction of the developing roller 17. That is, as shown in FIG. 9, the horizontal line h6 passing through the lower end of the communication port 18*c* (the upper end of the second wall portion 18*d*2) is located higher than a horizontal line h7 passing through the contact position 21*c* of the developing blade 21 and the developing roller 17.

(iv) The upper surface of the third wall portion 18*d*3 among the inner surfaces of the developing chamber 18*b* forming the second space and the third space is arranged as follows. First, a vertical line is drawn with reference to the end portion 21*b* (free end tip) located on the upstream side in the rotation direction of the developing roller 17 with respect to the contact position 21*c* of the developing blade 21 and the developing roller 17 (see FIG. 9). The position of the intersection between this vertical line and the inner surface of the developing chamber 18*b* (the upper surface of the third wall portion 18*d*3) facing the second space is taken as a reference, and the aforementioned surface is disposed to extend substantially horizontally from the reference point toward the third space side, with the narrow portion being interposed therebetween, from a position horizontally spaced from the narrow portion.

(v) The lower end of the communication port 18*c* is disposed higher than the lower end of the toner supply roller 20. That is, as shown in FIG. 9, the horizontal line h6 passing through the lower end of the communication port 18*c* (the upper end of the second wall portion 18*d*2) is located above the horizontal line h8 passing through the lower end of the toner supply roller 20.

Hereinafter, the operational effects of the arrangement configurations (i) to (v) will be described.

(i) Arrangement Relationship Between Upper End of Communication Port 18*c* and Upper End of Toner Supply Roller 20

As described above, the main toner supply to the toner supply roller 20 is performed by lifting the toner 40 by the stirring and conveying member 22 and supplying the toner directly above the nip portion N (first space). In the present embodiment, since the upper end of the communication port 18*c* is disposed higher than the upper end of the toner supply roller 20, the toner 40 can be supplied over the toner supply roller 20 to the suction port of the toner supply roller 20 above the nip portion N (first space) (the toner supply roller 20 sucks the toner 40 above the nip portion N because the toner supply roller rotates in the counter direction with respect to the developing roller 17). When the upper end of the communication port 18*c* is disposed lower than the upper end of the toner supply roller 20, the upper end of the communication port 18*c* blocks the toner supply path, and it becomes difficult to supply the toner directly to the space above the nip portion N with the stirring and conveying member 22. Further, in such a case, the toner 40 supplied to the side surface of the toner supply roller 20 is returned toward the toner storage chamber 18*a* by the rotation of the toner supply roller 20, and it is sometimes impossible to supply the sufficient amount of toner to the toner supply roller 20.

(ii) Arrangement Relationship between Center of Nip Portion N (Central Portion in Height Direction) and Lower End of Communication Port 18*c*

When the lower end of the communication port 18*c* is higher than the center position of the nip portion N (the height of the central portion in the height direction), the surface of the toner agent accommodated in the second space and the third space in the developing chamber 18*b* is higher than the center of the nip portion N. In such an arrangement, the toner 40 easily enters the nip portion N, and the mechanical stripping force of the toner supply roller 20 with respect to the toner 40 remaining on the developing roller 17 after the developing operation becomes weak. As a result, development streak caused by insufficient stripping can easily occur. Therefore, the position of the lower end of the communication port 18*c* needs to be provided lower at least the upper end of the nip portion N. That is, as shown in FIG. 9, the horizontal line h6 passing through the lower end of the communication port 18*c* is configured to be located below the horizontal line h3 passing through the upper end of the nip portion N. Furthermore, it is desirable that the lower end of the communication port 18*c* be disposed lower than the center position of the nip portion N because the stripping performance of the toner supply roller 20 can be improved. Furthermore, it is desirable that the lower end of the communication port 18*c* be disposed lower than the lower end of the nip portion N because the stripping performance of the toner supply roller 20 can be further improved. That is, as shown in FIG. 9, it is desirable that the horizontal line h6 passing through the lower end of the communication port 18*c* be located below the horizontal line h5 passing through the lower end of the nip portion N.

(iii) Arrangement Relationship between Lower End of Communication Port 18*c* and Tip of Developing Blade 21

The lower end of the communication port 18*c* is disposed at the same level as or higher than the end portion 21*b* at the contact position 21*c* between the developing blade 21 and the developing roller 17 on the upstream side in the rotation direction of the developing roller 17. In this way, the excess toner 40 regulated by the developing blade 21 is continuously supplied to the second space. By doing so, the degree of compaction of the toner 40 in the second space is further increased, and toner supply from the second space to the toner supply roller 20 and the flow of the toner 40 returning from the third space to the toner storage chamber 18*a* over the wall portion at the lower end of the communication port 18*c* can be formed. Where the lower end of the communication port 18*c* is lower than the end portion 21*b* on the upstream side in the rotation direction of the developing roller 17 with respect to the contact position 21*c* between the developing blade 21 and the developing roller 17, while other configuration requirements of the present embodiment are being satisfied, it is difficult to increase the degree of compaction in the second space.

(iv) Arrangement Relationship between Tip of Developing Blade 21 and Angle of Inner Wall Portion of Developing Container Further, in order for the toner 40 to move from the second space to the third space, it is necessary to set, as appropriate, the angle of the inner surface of the wall portion of the developing frame 18 (the upper surface of the third wall portion 30*c*) facing the second space and the third space so as not to hinder the movement of the toner 40. Accordingly, in the present embodiment, the inner surface of the wall portion of the developing frame 18 from a position separated in the horizontal direction with respect to the narrow portion is configured to be substantially horizontal from the intersection of the above-described vertical line (see FIG. 9) and the inner surface of the wall portion of the developing frame 18 (the upper surface of the third wall portion 18*d*3). In this way, the toner 40 that has fallen into the second space after being supplied from the toner supply roller 20 to the developing roller 17 and regulated by the developing blade 21 moves toward the third space across the narrow portion.

A configuration may be used in which the toner falls from the second space to the third space (the upper surface of the third wall portion 18*d*3 is inclined) so that the toner is more easily moved from the second space to the third space. By doing so, toner circulation from the second space to the third space can be further promoted.

(v) Arrangement Relationship between Lower End of Communication Port 18*c* and Toner Supply Roller 20

Further, in the configuration of the present embodiment, the lower end of the communication port 18*c* is disposed higher than the lower end of the toner supply roller 20. By doing so, the amount of toner returning from the third space to the toner storage chamber 18*a* can be controlled to an appropriate amount, whereby an appropriate compaction space can be formed in the second space.

The developing chamber 18*b* is provided with a developing opening as an opening for carrying the toner 40 to the outside of the developing container 18, and the developing roller 17 is rotatably assembled to the developing container 18 in an arrangement such as to close the developing opening. That is, the toner 40 accommodated in the developing container 18 is borne and conveyed by the rotating developing roller 17 to pass through the developing opening, move to the outside of the developing container 18, and develop the electrostatic latent image on the photosensitive drum 1. At that time, the amount of toner carried out of the developing container 18 is regulated and adjusted by the developing blade 21. The toner storage chamber 18*a* is located below the developing chamber 18*b* in the direction of gravity. The position where the developing blade 21 contacts the developing roller 17 is located lower than the rotation center of the developing roller 17 and between the rotation center of the developing roller 17 and the rotation center of the toner supply roller 20 in the horizontal direction.

The stirring and conveying member 22 stirs the toner 40 accommodated in the toner storage chamber 18*a* and conveys the toner 40 in the direction of arrow G in the drawing toward the upper portion of the toner supply roller 20 in the developing chamber 18*b*. In the present embodiment, the stirring and conveying member 22 is driven to rotate at a rotational speed of 130 rpm. The developing roller 17 and the photosensitive drum 1 rotate so that the surfaces thereof in the opposing portions move in the same direction (in the present embodiment, the direction from the bottom to the top). Further, in the present embodiment, the developing roller 17 is disposed in contact with the photosensitive drum 1. However, the developing roller 17 may be disposed close to the photosensitive drum 1 with a predetermined gap therebetween. In the present embodiment, the toner 40, which is negatively charged by triboelectric charging with respect to a predetermined DC bias applied to the developing roller 17, is transferred by this potential difference only to the bright section potential portion to visualize the electrostatic latent image in the developing portion that is in contact with the photosensitive drum 1. In the present embodiment, by applying V=−300 V to the developing roller 17, a potential difference ΔV=200 V with the bright section is formed, and a toner image is formed.

Configuration of Developing Blade

The developing blade 21 is disposed to face the counter direction with respect to the rotation of the developing roller 17 and is a member that regulates the amount of toner borne on the developing roller 17. In addition, the toner 40 is imparted with an electric charge as a result of being triboelectrically charged by sliding between the developing blade 21 and the developing roller 17, and at the same time, the layer thickness thereof is regulated. In the developing blade 21, one end portion 21*a* in the short direction perpendicular to the longitudinal direction is fixed to the developing container 18 by a fastener such as a screw, and the other end portion 21*b* is a free end. The direction in which the developing blade 21 extends from the one end 21*a* fixed to the developing container 18 to the other end 21*b* in contact with the developing roller 17 is opposite (counter direction) to the rotation direction of the developing roller 17 in the portion in contact with the developing roller 17.

In the present embodiment, a leaf spring-shaped SUS thin plate having a free length in the short direction of 8 mm and a thickness of 0.08 mm is used as the developing blade 21. Here, the developing blade 21 is not limited to this configuration, and may be a thin metal plate such as phosphor bronze or aluminum.

A predetermined voltage is applied to the developing blade 21 from a blade bias power supply (not shown) to stabilize the toner coat, and V=−500 V is applied as the blade bias.

Figure 3:
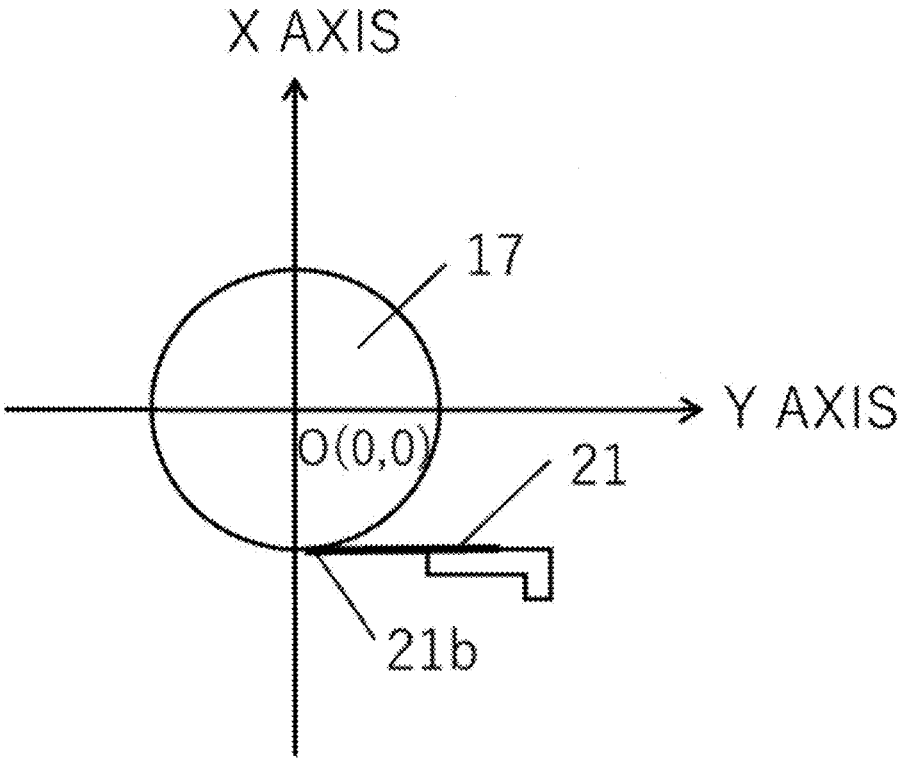
FIG. 3 is an explanatory diagram of the positional relationship between the developing blade and the developing roller in the embodiment.

Here, a method for changing the contact pressure N (gf/mm) of the developing blade 21 against the surface of the developing roller 17 will be described with reference to FIG. 3. FIG. 3 is a schematic diagram for explaining the positional relationship between the developing blade 21 and the developing roller 17. A coordinate system in a cross section perpendicular to the rotational axis of the developing roller 17 as shown in FIG. 3 will be considered. That is, in the cross section, a direction substantially parallel to the direction in which the developing blade 21 extends while being pressed against the developing roller 17 is taken as a y-axis, and a direction perpendicular to the y-axis is taken as an x-axis. This is a coordinate system in which the origin point is the rotation center O of the developing roller 17, and the center coordinates of the developing roller 17 are (x, y)=(0, 0). In this coordinate system, the position of the developing blade tip 21*b* in the x-axis direction is an X value, and the position in the y-axis direction is an Y value. When changing the contact pressure N (gf/mm), the X value and the Y value are changed.

Configuration of Toner Supply Roller

The toner supply roller 20 and the developing roller 17 rotate so that the surfaces thereof move in different directions at the nip portion N where the rollers are in contact with each other. In the present embodiment, the toner supply roller 20 rotates so that the surface thereof moves in a direction at the nip portion N from the lower side toward the upper side, and the developing roller 17 rotates so that the surface thereof moves in a direction at the nip portion N from the upper side toward the lower side. That is, the toner supply roller 20 rotates in the direction of the arrow E (clockwise direction) in the figure and the developing roller 17 rotates in the direction of the arrow D (counterclockwise direction).

The toner supply roller 20 is an elastic sponge roller in which a foam layer is formed on the outer periphery of a conductive metal core. The toner supply roller is made of a flexible material, for example, foamed polyurethane and the like and has a structure that can easily hold the toner in cells having a diameter of 50 μm to 500 μm. Further, the hardness is 50° to 80° (Asker F) and enables uniform contact with the developing roller 17. The resistance value of $1.0\times10^8$ was calculated from a current value obtained when a stainless steel cylindrical member having an outer diameter of 30 mm and the toner supply roller 20 were brought into contact with each other, and a DC voltage of 100 V was applied between the metal core of the toner supply roller 20 and the stainless steel cylindrical member; the measurement environment was 23.0° C. and 50% RH. The toner supply roller 20 and the developing roller 17 rotate at the nip portion N in opposite directions with a circumferential speed difference. With this operation, the toner is supplied to the developing roller 17 by the toner supply roller 20. At that time, the toner supply amount to the developing roller 17 can be adjusted by adjusting the potential difference between the toner supply roller 20 and the developing roller 17.

In the present embodiment, the toner supply roller 20 is driven and rotated at a rotational speed of 700 rpm and the developing roller 17 is driven and rotated at 700 rpm, and a voltage of V=−400 V is applied to the toner supply roller 20 so that the toner supply roller 20 is at Δ−100 V with respect to the developing roller 17. As a result, the toner 40 is easily electrically supplied from the toner supply roller 20 to the developing roller 17.

The rotational speed (rpm) per unit time of the toner supply roller 20 and the developing roller 17 shown herein is an example, and is set, as appropriate, depending on the relative balance of the moving speeds of the respective peripheral surfaces. That is, the rotational speed shown herein is not limiting, provided that in the nip portion N, the peripheral surface of the toner supply roller 20 moves in the direction opposite to the direction in which the peripheral surface of the developing roller 17 moves and from the lower side to the upper side, and that the configuration ensures rotation with the same peripheral speed difference as the configuration of the present embodiment.

Figure 4:
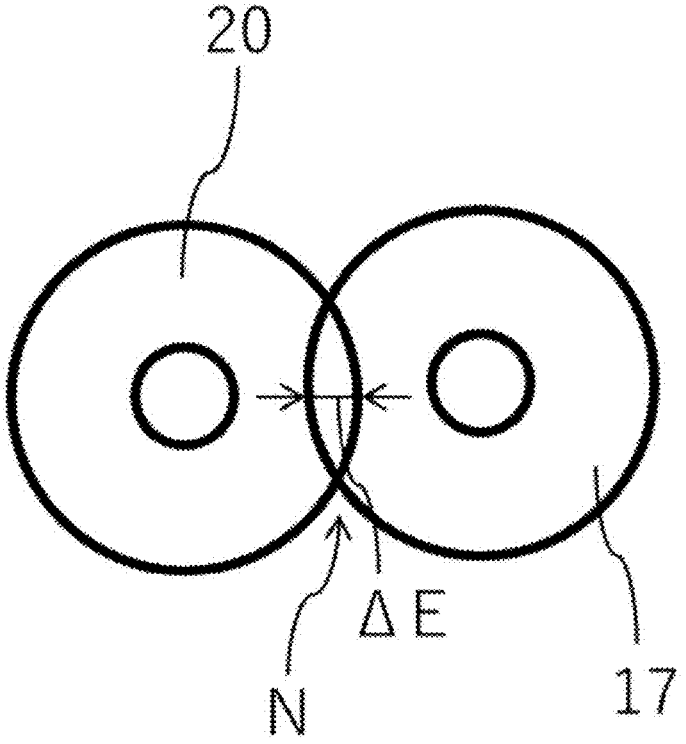
FIG. 4 is an explanatory diagram of the positional relationship between the toner supply roller and the developing roller in the embodiment.

Further, a method for changing the contact pressure D (gf/mm) of the toner supply roller 20 against the surface of the developing roller 17 will be described herein with reference to FIG. 4. FIG. 4 is a schematic diagram for explaining the positional relationship between the toner supply roller 20 and the developing roller 17. As shown in FIG. 4, the toner supply roller 20 and the developing roller 17 are in contact with each other with a predetermined penetration amount, and the toner supply roller 20 has a recess amount ΔE by which the toner supply roller is recessed by the developing roller 17. As shown in FIG. 4, the recess amount ΔE is defined as an overlap amount of the developing roller 17 and the toner supply roller 20 when the two rollers virtually overlap in a state in which contact causes no deformation, as viewed in the rotational axis direction of the developing roller 17 or the toner supply roller 20. Specifically, as shown in FIG. 4, when viewed in the rotational axis direction, the recess amount ΔE is the length of a line segment connecting one point on the outer periphery of the developing roller 17 that has entered the toner supply roller 20 at maximum and one point on the outer periphery of the supply roller 20 that has entered the developing roller 17 at maximum. Alternatively, as viewed in the direction of the rotational axis, the recess amount ΔE is the length of a line segment region intersecting with the line connecting the rotation centers of the toner supply roller 20 and the developing roller 17 in the overlapping portion of the virtually overlapped toner supply roller 20 and the developing roller 17. The contact pressure D (gf/mm) is changed by changing the recess amount ΔE. Both the toner supply roller 20 and the developing roller 17 have an outer diameter of 15 mm. Further, the toner supply roller 20 and the developing roller 17 are arranged so that the center heights are substantially the same.

Method for Measuring Contact Pressure

The measurement of the contact pressure N (gf/mm) of the developing blade 21 against the surface of the developing roller 17 is performed as follows. The developing device from which the developing roller 17 has been removed is mounted on a dedicated measuring jig, and measurement is performed by bringing the developing blade 21 into contact with an aluminum sleeve having the same diameter as the developing roller 17 as a virtual developing roller. The length of the measuring element is 50 mm, and the contact pressure of the toner supply roller 20 is calculated from the average value at two measurement points at both ends and three measurement points at the center.

The measurement of the contact pressure D (gf/mm) of the toner supply roller 20 against the surface of the developing roller 17 is performed as follows. The toner supply roller 20 is mounted on a dedicated measuring jig, and the measurement is performed by bringing the toner supply roller 20 into contact with an aluminum sleeve having the same diameter as the developing roller 17 as a virtual developing roller. The length of the measuring element is 50 mm, and the contact pressure of the toner supply roller 20 is calculated from the average value at two measurement points at both ends and one measurement point at the center.

The measurement of the contact pressure was carried out after the test specimen was allowed to stand overnight in an environment of normal temperature and normal humidity (25° C./50%) and was fully acclimatized to the environment.

Table 1 shows the relationship between the contact pressure D (gf/mm) of the toner supply roller against the surface of the developing roller and the recess amount ΔE by which the toner supply roller is recessed by the developing roller in the present embodiment. Table 2 shows the relationship between the contact pressure N (gf/mm) of the developing blade against the surface of the developing roller and the X value and Y value of the developing blade tip 21*b* in the present embodiment.

TABLE 1

| Recess amount ΔE(mm) | Contact pressure D(gf/mm) |
|---|---|
| 0.4 | 1.5 |
| 0.6 | 2.0 |
| 1.0 | 3.0 |
| 1.2 | 3.5 |
| 1.6 | 4.5 |
| 1.8 | 5.0 |

TABLE 2

| X value(mm) | Y value(mm) | Contact pressure N(gf/mm) |
|---|---|---|
| −5.55 | 0.6 | 1.2 |
| −5.45 | 0.6 | 1.5 |
| −5.40 | 0.6 | 1.7 |
| −5.30 | 0.6 | 2.0 |
| −5.00 | 0.6 | 3.0 |
| −4.70 | 0.6 | 4.0 |
| −4.55 | 0.6 | 4.5 |
| −4.45 | 0.6 | 4.8 |

Toner Used in Present Embodiment

Figure 5:
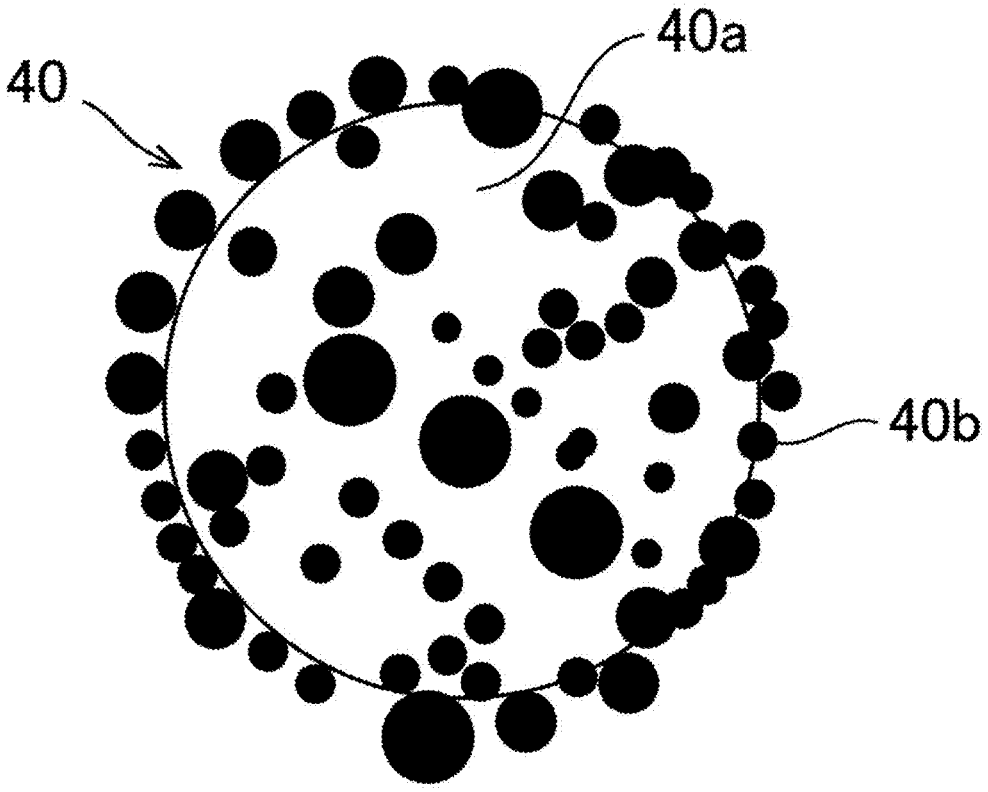
FIG. 5 is a schematic diagram of a toner having a surface layer to which inorganic particles have been externally added in the embodiment.

FIG. 5 shows a schematic diagram of the toner 40 used in the present embodiment. In the present embodiment, the toner 40 in which inorganic particles 40*b* are externally added to the toner particle 40*a* is used.

Hereinafter, "part" of each material is based on mass unless otherwise specified.

Step of Preparing Aqueous Medium 1

A total of 14.0 parts of sodium phosphate (RASA Industries, Ltd., dodecahydrate) was added to 1000.0 parts of ion exchanged water in a reaction vessel, and kept at 65° C. for 1.0 h while purging with nitrogen.

An aqueous calcium chloride solution obtained by dissolving 9.2 parts of calcium chloride (dihydrate) in 10.0 parts of ion exchanged water was batch-loaded while stirring at 12,000 rpm using a T. K. Homomixer (manufactured by Tokushu Kika Kogyo Co., Ltd.) to prepare an aqueous medium including a dispersion stabilizer. Furthermore, 10% by mass hydrochloric acid was added to the aqueous medium, and the pH was adjusted to 5.0, whereby an aqueous medium 1 was obtained.

Step of Preparing Polymerizable Monomer Composition

| | |
|---|---|
| Styrene | 60.0 parts |
| C. I. Pigment Blue 15:3 | 6.5 parts |

The aforementioned materials were put into an attritor (manufactured by Mitsui Miike Chemical Engineering Machinery, Co., Ltd.), and further dispersed using zirconia particles having a diameter of 1.7 mm at 220 rpm for 5.0 h to prepare a pigment-dispersed solution. The following materials were added to the pigment-dispersed solution.

| | |
|---|---|
| Styrene | 20.0 parts |
| n-Butyl acrylate | 20.0 parts |
| Crosslinking agent (divinylbenzene) | 0.3 parts |
| Saturated polyester resin | 5.0 parts |

(Polycondensation product of propylene oxide-modified bisphenol A (2 mol adduct) and terephthalic acid (molar ratio 10:12), glass transition temperature Tg=68° C., weight average molecular weight Mw=10,000, molecular weight distribution Mw/Mn=5.12)

| | |
|---|---|
| Fischer-Tropsch wax (melting point 78° C.) | 7.0 parts |

The pigment-dispersed solution to which the above materials were added was kept at 65° C. and uniformly dissolved and dispersed at 500 rpm using a T. K. Homomixer (manufactured by Tokushu Kika Kogyo Co., Ltd.) to prepare a polymerizable monomer composition.

Granulation Step

The polymerizable monomer composition was loaded into the aqueous medium 1 while maintaining the temperature of the aqueous medium 1 at 70° C. and the rotational speed of the T. K. Homomixer at 12,000 rpm, and 9.0 parts of t-butyl peroxypivalate as a polymerization initiator was added. The mixture was granulated for 10 min while maintaining 12,000 rpm of the stirring device.

Polymerization Step

After the granulation step, the stirrer was replaced with a propeller stirring blade and polymerization was performed for 5.0 h while maintaining at 70° C. under stirring at 150 rpm, and then polymerization reaction was carried out by raising the temperature to 85° C. and heating for 2.0 h to obtain toner particles. When the pH of the slurry was measured after cooling to 55° C., the pH was 5.0.

Washing and Drying Step

After completion of the polymerization step, the toner particle slurry was cooled, hydrochloric acid was added to the toner particle slurry to adjust the pH to 1.5 or lower, the slurry was allowed to stand under stirring for 1 h, and then solid-liquid separation was performed with a pressure filter to obtain a toner cake. The toner cake was reslurried with ion exchanged water to obtain a dispersion liquid again, followed by solid-liquid separation with the above-mentioned filter. Reslurrying and solid-liquid separation were repeated until the electric conductivity of the filtrate became 5.0 μS/cm or less, and finally solid-liquid separation was performed to obtain a toner cake.

The obtained toner cake was dried with an air flow drier FLASH JET DRIER (manufactured by Seishin Enterprise Co., Ltd.), and fine particles were cut using a multi-division classifier utilizing the Coanda effect to obtain toner particles a. The drying conditions were a blowing temperature of 90° C. and a dryer outlet temperature of 40° C., and the supply speed of the toner cake was adjusted so that the outlet temperature did not deviate from 40° C. according to the moisture content of the toner cake. Toner particles b to toner particles f were obtained by changing the rotation speed of the stirrer and the granulation time in the granulation step.

External Addition Step

In the present embodiment, toner a to toner f were prepared by externally adding inorganic particles to the obtained toner particles a to toner particles f under the following conditions.

External Addition Conditions for Inorganic Particles

A total of 2.0 parts to 5.0 parts of silica fine particles (number average particle diameter of primary particles: 10 nm) were dry mixed with 100 parts of toner particles with a Henschel mixer (FM-10C, manufactured by Mitsui Mining Co., Ltd.) for 10 min to 30 min.

The measurement of the aspect ratio of the toner, the fixing ratio of the inorganic particles to the toner particles, and the coverage of the toner particle with the inorganic particles was carried out by the methods described in the Description of the Embodiments. The results are shown in Table 3.

TABLE 3

| | Aspect ratio of toner | Adhesion ratio of inorganic fine particles(%) | Coverage of inorganic fine particles(%) |
|---|---|---|---|
| Toner a | 0.92 | 95 | 95 |
| Toner b | 0.95 | 90 | 90 |
| Toner c | 0.94 | 85 | 85 |
| Toner d | 0.90 | 80 | 80 |
| Toner e | 0.91 | 75 | 75 |
| Toner f | 0.86 | 80 | 80 |

Contents of Test 1

In the configuration of the present embodiment, the following test was performed.

The contact pressure of the developing blade against the surface of the developing roller was set to 3.5 (gf/mm), the contact pressure of the toner supply roller against the surface of the developing roller was set to 3.0 (gf/mm), and toners a to f were used to evaluate the development streaks, toner charge quantity maintenance performance, density unevenness, and dropout.

As for the evaluation conditions, the toner was allowed to stand overnight in an environment of room temperature and normal humidity (25° C./50%) and was fully acclimatized to the environment. Then, image formation for forming a test image on the recording material was intermittently performed on 10,000 recording materials (durability test), following by the above-described evaluation. In the present embodiment, a horizontal line with an image print percentage of 5% was used as the test image.

The evaluation method will be described in detail below.

Evaluation of Development Streaks

A halftone image (toner laid-on level: 0.2 mg/cm$^2$) was printed on LETTER size XEROX 4200 paper (manufactured by XEROX Corp., 75 g/m$^2$), and the development streaks were ranked as follows. B or higher was determined as satisfactory.

A: no vertical streak in the paper discharge direction is seen on the developing roller or the image.

B: slight thin streaks in the circumferential direction are seen at both ends of the developing roller, or there are only a few vertical streaks in the paper discharge direction on the image.

C: many streaks are observed on the developing roller. Alternatively, one or more noticeable streaks or a large number of fine streaks are seen on the image.

Evaluation of Toner Charge Quantity

Figure 6:
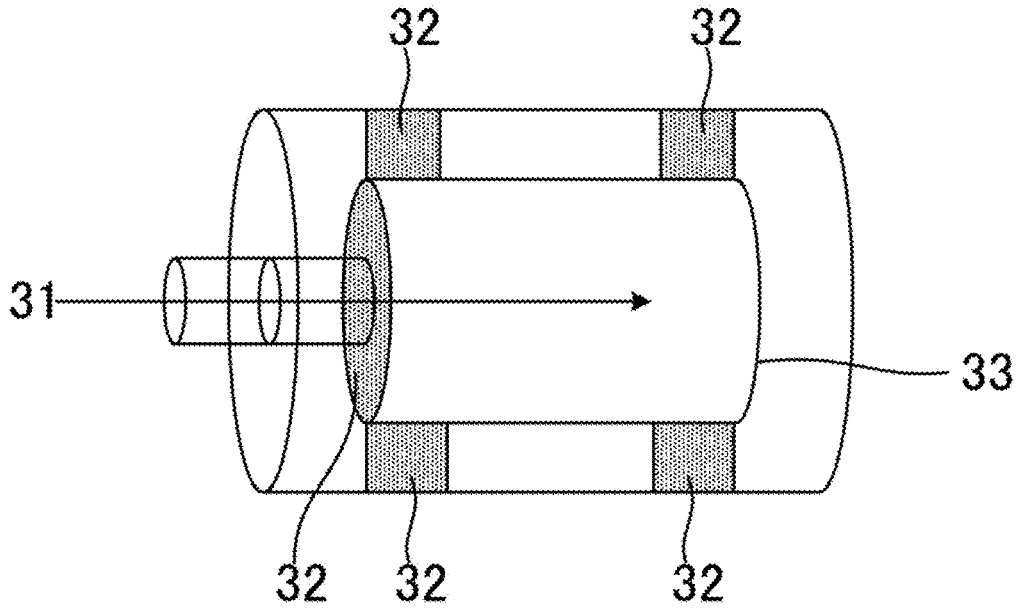
FIG. 6 is an example of a Faraday cage.

A total of 10 solid black images are outputted. The machine is forcibly stopped during the output of the tenth sheet, and the toner charge quantity on the developing roller immediately after passing through the regulating blade is measured. The charge quantity on the developing roller was measured using a Faraday cage shown in the perspective view of FIG. 6. The inside (right side in the figure) was depressurized so that the toner on the developing roller was sucked in, and a toner filter 33 was provided to collect the toner. Here, 31 is a suction part and 32 is a holder. From the mass M of the collected toner and the total charge quantity Q directly measured by a coulomb meter, a charge quantity per unit mass Q/M (μC/g) was calculated as a toner charge quantity (Q/M). The ranking was as follows.

A: less than −35 μC/g

B: at least −35 μC/g and less than −29 μC/g

C: −29 μC/g or more

Evaluation of Density Unevenness

Halftone images (toner loading: 0.2 mg/cm$^2$) were printed on LETTER size XEROX 4200 paper (manufactured by XEROX Corp., 75 g/m$^2$), and density unevenness was ranked as follows. B or higher was determined as satisfactory. The measurement was performed using a spectrodensitometer 500 manufactured by X-Rite.

A: density difference on the image is less than 0.2

B: density difference on the image is at least 0.2 and less than 0.3

C: density difference on the image is 0.3 or more

Evaluation of Dropout

After completion of the durability test, the image forming apparatus was disassembled, and it was investigated whether or not there was a toner dropout on the developing blade. The evaluation was by O and X.

The occurrence of "toner dropout" in this evaluation is a state in which the toner is falling on the developing blade, without being held on the developing roller, in the downstream portion of the developing roller with respect to the toner regulating portion. Where image formation is continued in a state where toner dropout has occurred, contamination in the image forming main body and the recording paper will develop and image quality will deteriorate.

Test Results 1

Table 4 hereinbelow shows the evaluation results of the development streak, toner charge quantity maintenance performance, and density unevenness of this example.

TABLE 4

| | Initial stage | After 10,000 prints | | | |
|---|---|---|---|---|---|
| | Charge quantity (μC/g) | Charge quantity (μC/g) | Development streaks | Density unevenness | Dropout |
| Toner a | −45(A) | −38(A) | A | A | ○ |
| Toner b | −44(A) | −36(A) | A | A | ○ |
| Toner c | −45(A) | −40(A) | A | A | ○ |
| Toner d | −43(A) | −31(B) | B | B | ○ |

TABLE 4-continued

| | Initial stage | After 10,000 prints | | | |
|---|---|---|---|---|---|
| | Charge quantity (μC/g) | Charge quantity (μC/g) | Development streaks | Density unevenness | Dropout |
| Toner e | −44(A) | −20(C) | C | C | X |
| Toner f | −40(A) | −20(C) | C | C | X |

First, in the configuration of the present embodiment, when the toners a to d were used, the fixing ratio was 80% or more, so that the charge quantity could be maintained while suppressing development streaks. Therefore, the occurrence of density unevenness could be suppressed.

When the toner e was used, the fixing ratio was less than 80%, so the toner was fused to the developing blade and the developing roller, and development streaks occurred. In addition, the toner could not withstand the shear with the charge imparting member, the charge quantity of the toner was reduced, and density unevenness due to potential unevenness and dropout occurred.

Therefore, the fixing ratio is 80% or more.

Further, when the toner f was used, since the toner had an aspect ratio of less than 0.90, the toner was fused to the developing blade and the developing roller and development streaks have occurred. In addition, the toner could not withstand the shear with the charge imparting member, the charge quantity of the toner was reduced, and density unevenness due to potential unevenness and dropout occurred. Therefore, the toner aspect ratio is 0.90 or more.

From these test results, the following was found.

When the contact pressure of the developing blade against the surface of the developing roller was set to 3.5 (gf/mm), the contact pressure D of the toner supply roller against the surface of the developing roller was set to 3.0 (gf/mm), the fixing ratio of inorganic particles to the toner particle was 80% or more and the toner aspect ratio was 0.90 or more, the charge quantity could be maintained while suppressing the development streaks due to fusion.

Contents of Test 2

In the configuration of this example, the following test was performed.

Development streaks, density unevenness and dropout were evaluated by somewhat varying the contact pressure N (gf/mm) of the developing blade against the surface of the developing roller and the contact pressure D (gf/mm) of the toner supply roller against the surface of the developing roller and using the toners a and c.

Evaluation conditions and evaluation methods were the same as in "Contents of Test 1".

Test Results 2

Figure 7:
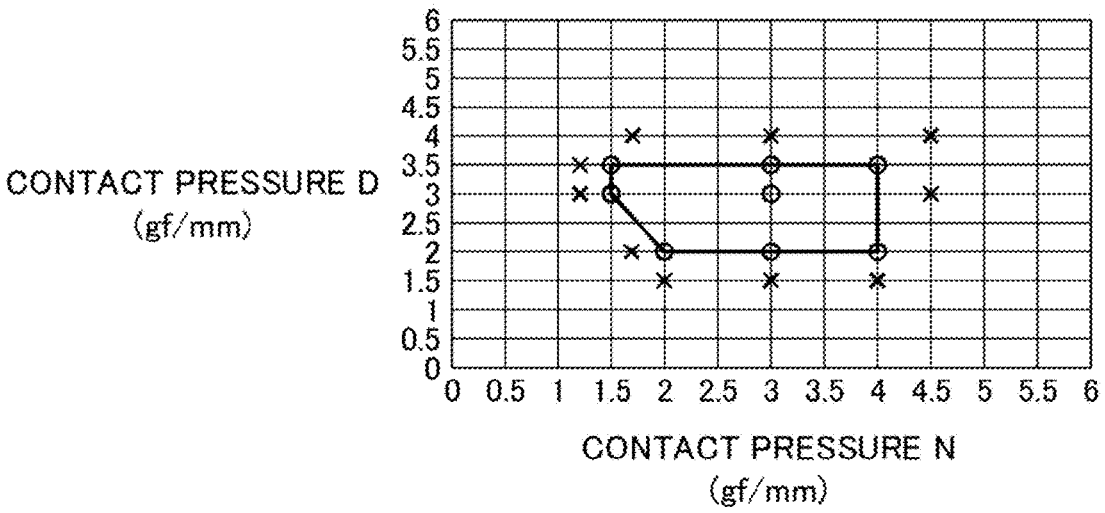
FIG. 7 is a graph showing a range in which density unevenness can be suppressed without image defects.

Tables 5 and 6 show the evaluation results of development streaks and density unevenness in the toners a and c when the contact pressure N and the contact pressure D were varied. In addition, a black line frame in FIG. 7 shows a range in which the high charging performance of the developer can be maintained for a long time without causing image defects and the occurrence of density unevenness due to potential unevenness can be suppressed.

TABLE 5

| | N(gf/mm) | D(gf/mm) | Alter 10,000 prints Development streaks | Density unevenness | Dropout |
|---|---|---|---|---|---|
| Toner a | 2.0 | 2.0 | A | B | ○ |
| | 4.0 | 2.0 | A | A | ○ |
| | 1.5 | 3.0 | A | B | ○ |
| | 1.5 | 3.5 | A | B | ○ |
| | 4.0 | 3.5 | B | A | ○ |
| | 3.0 | 3.5 | A | A | ○ |
| | 3.0 | 3.0 | A | A | ○ |
| | 3.0 | 2.0 | A | B | ○ |
| | 2.0 | 1.5 | A | C | ○ |
| | 4.0 | 1.5 | A | C | ○ |
| | 1.7 | 2.0 | A | C | ○ |
| | 1.2 | 3.0 | C | C | X |
| | 4.5 | 3.0 | C | B | ○ |
| | 1.2 | 3.5 | C | C | X |
| | 1.7 | 4.0 | C | B | ○ |
| | 4.5 | 4.0 | C | B | ○ |
| | 3.0 | 4.0 | C | B | ○ |
| | 3.0 | 1.5 | A | C | ○ |

TABLE 6

| | N(gf/mm) | D(gf/mm) | After 10,000 prints Development streaks | Density unevenness | Dropout |
|---|---|---|---|---|---|
| Toner c | 2.0 | 2.0 | A | B | ○ |
| | 4.0 | 2.0 | B | A | ○ |
| | 1.5 | 3.0 | A | B | ○ |
| | 1.5 | 3.5 | A | B | ○ |
| | 4.0 | 3.5 | B | A | ○ |
| | 3.0 | 3.5 | B | A | ○ |
| | 3.0 | 3.0 | B | A | ○ |
| | 3.0 | 2.0 | A | B | ○ |
| | 2.0 | 1.5 | A | C | ○ |
| | 4.0 | 1.5 | A | C | ○ |
| | 1.7 | 2.0 | A | C | ○ |
| | 1.2 | 3.0 | C | C | X |
| | 4.5 | 3.0 | C | B | ○ |
| | 1.2 | 3.5 | C | C | X |
| | 1.7 | 4.0 | C | B | ○ |
| | 4.5 | 4.0 | C | B | ○ |
| | 3.0 | 4.0 | C | B | ○ |
| | 3.0 | 1.5 | A | C | ○ |

In the configuration of the present embodiment, where $D+2\times N-6\geq 0$, $1.5\leq N\leq 4.0$, and $2.0\leq D\leq 3.5$, the charge quantity could be maintained while suppressing development streaks due to member scraping.

In the case of $D+2\times N-6<0$, since the shear of the toner with the charge imparting member (developing blade) is weak, the toner charge quantity is insufficient and density unevenness due to potential unevenness occurs.

When $N>4.0$ or $D>3.5$, since the shear of the toner is too strong, the toner is fused to the toner supply roller or the developing blade, and development streaks occur.

When $D<2.0$, the toner supply amount from the toner supply roller to the developing roller is insufficient, and density unevenness occurs.

When $N<1.5$, the contact pressure of the developing blade against the surface of the developing roller is insufficient, and the dropout occurs. In addition, the toner that has fallen off obstructs the coating on the developing roller, thereby causing development streaks.

From the above results, first, as the toner, a toner having a fixing ratio of inorganic particles present on the surface of the toner particle of 80% or more and an aspect ratio of the toner of 0.90 or more is used. Further, when the contact pressure of the developing blade against the surface of the developing roller is denoted by N (gf/mm) and the contact pressure of the toner supply roller against the surface of the developing roller is denoted by D (gf/mm), the configuration satisfying the following relationships is used:

$$D+2\times N-6\geq 0,$$

$$1.5\leq N\leq 4.0, \text{ and}$$

$$2.0\leq D\leq 3.5.$$

Where such a configuration is adopted, it is possible to maintain the high charging performance of the developer for a long period of time without image defects, and to suppress the occurrence of density unevenness due to potential unevenness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-213818, filed on Nov. 14, 2018, which is hereby incorporated by reference herein in its entirety.

What is claimed is:

1. A developing device comprising:

a developer bearing member that bears a developer on a surface thereof;

a supplying member that contacts the surface of the developer bearing member and supplies the developer to the surface of the developer bearing member; and a regulating member that contacts the surface of the developer bearing member and regulates the developer borne on the surface of the developer bearing member, wherein the developer includes a toner having a toner particle and an inorganic particle present on a surface of the toner particle;

a fixing ratio of the inorganic particle to the surface of the toner particle is 80% or more;

an aspect ratio of the toner is 0.90 or more;

wherein a contact pressure of the regulating member against the surface of the developer bearing member is denoted by N (gf/mm) and a contact pressure of the supplying member against the surface of the developer bearing member is denoted by D (gf/mm), the following expressions are satisfied:

$$D+2\times N-6\geq 0,$$

$$1.5\leq N\leq 4.0, \text{ and}$$

$$2.0\leq D\leq 3.5.$$

2. The developing device according to claim 1, wherein the inorganic particle is at least one type of particle selected from the group consisting of silica particle, titanium oxide particle, magnesium oxide particle, strontium titanate particle, and alumina particle.

3. The developing device according to claim 1, wherein a transferability of the developer is less than 3 mg/sec.

4. The developing device according to claim 1, wherein a coverage of the surface of the toner particle by the inorganic particle is at least 80% and not more than 100%.

5. The developing device according to claim 1, wherein the developer is a non-magnetic one-component toner.

6. The developing device according to claim 1, wherein the developer bearing member and the supplying member rotate so that surfaces thereof move in different directions at a nip portion where the developer bearing member and the supplying member are in contact with each other.

7. The developing device according to claim 6, wherein in a posture at the time of use, the supplying member rotates so that the surface thereof moves in a direction at the nip portion from a lower side toward an upper side.

8. The developing device according to claim 6, wherein a number of rotations per unit time of the developer bearing member and a number of rotations per unit time of the supplying member are the same.

9. The developing device according to claim 6, wherein in a posture at the time of use, a position where the regulating member contacts the developer bearing member is lower than the nip portion.

10. The developing device according to claim 6, wherein in a posture at the time of use, a position where the regulating member contacts the developer bearing member is located lower than a rotation center of the developer bearing member and between the rotation center of the developer bearing member and a rotation center of the supplying member in a horizontal direction.

11. The developing device according to claim 1 further comprising:

a frame accommodating the developer, wherein the regulating member has, one end fixed to the frame, and the other end, which is a free end and which contacts the developer bearing member, and a direction extending from the one end to the other end is a direction opposite to the rotation direction of the developer bearing member, at a portion where the regulating member is in contact with the developer bearing member.

12. The developing device according to claim 1 further comprising:

a frame accommodating the developer, wherein the frame includes:

a developing chamber in which the developer bearing member, the supplying member and the regulating member are disposed;

an accommodating chamber that is located lower than the developing chamber in a posture at the time of use and accommodates the developer to be supplied to the developing chamber; and a partition wall portion having a communication port communicating the accommodating chamber and the developing chamber, and wherein the developing device further includes:

a conveying member that is disposed in the accommodating chamber and conveys the developer from the accommodating chamber to the developing chamber through the communication port.

13. The developing device according to claim 12, wherein the position of the boundary between the partition wall portion and the upper end of the communication port is higher than the upper end of the supplying member.

14. The developing device according to claim 12, wherein the position of the boundary between the partition wall portion and the lower end of the communication port is higher than the lower end of the supplying member.

15. A process cartridge comprising:

the developing device according to claim 1; and an image bearing member on which an electrostatic latent image, to be developed by the developing device, is formed, wherein the process cartridge is capable of being detachably attached to a main body of an image forming apparatus.

16. An image forming apparatus comprising:

the developing device according to claim 1; and an image bearing member on which an electrostatic latent image, to be developed by the developing device, is formed.

* * * * *